US012467175B2

(12) United States Patent
Abe et al.

(10) Patent No.: US 12,467,175 B2
(45) Date of Patent: Nov. 11, 2025

(54) SEWING SYSTEM, STORAGE MEDIUM STORING MONITORING PROGRAM, AND SEWING MACHINE

(71) Applicant: BROTHER KOGYO KABUSHIKI KAISHA, Nagoya (JP)

(72) Inventors: Daisuke Abe, Nagoya (JP); Sayaka Kurihara, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/667,728

(22) Filed: May 17, 2024

(65) Prior Publication Data

US 2024/0401256 A1 Dec. 5, 2024

(30) Foreign Application Priority Data

May 30, 2023 (JP) ..... 2023-089094

(51) Int. Cl.
*D05B 19/10* (2006.01)
*D05B 19/14* (2006.01)
*D05C 5/02* (2006.01)

(52) U.S. Cl.
CPC ..... *D05B 19/10* (2013.01); *D05B 19/14* (2013.01); *D05C 5/02* (2013.01); *D05D 2205/02* (2013.01)

(58) Field of Classification Search
CPC ..... D05B 19/10; D05B 19/12; D05B 19/14; D05B 19/16; D05C 5/02; D05D 2205/02
See application file for complete search history.

(56) References Cited

U.S. PATENT DOCUMENTS

2015/0040810 A1 2/2015 Kongo et al.
2019/0040557 A1* 2/2019 Chen ..... D05B 19/085

FOREIGN PATENT DOCUMENTS

JP 2015-033468 A 2/2015

* cited by examiner

*Primary Examiner* — Nathan E Durham
(74) *Attorney, Agent, or Firm* — Oliff PLC

(57) ABSTRACT

A sewing system includes a sewing machine and a terminal apparatus. The sewing machine includes a needle bar, a communication interface, and a controller. The communication interface is configured to communicate with the terminal apparatus. The controller is configured to perform: receiving sewing data transmitted from the terminal apparatus via the communication interface, the sewing data including needle position data indicating needle positions for sewing an embroidery pattern; performing a sewing control operation of driving the needle bar to sew the embroidery pattern based on the sewing data; and in response to determining that the sewing machine has stopped during execution of the sewing control operation and has restarted and in response to receiving restoration data corresponding to the sewing data from the terminal apparatus via the communication interface, driving the needle bar to resume the sewing control operation based on the restoration data.

19 Claims, 12 Drawing Sheets

SEWING SYSTEM, STORAGE MEDIUM STORING MONITORING PROGRAM, AND SEWING MACHINE

REFERENCE TO RELATED APPLICATIONS

This application claims priority from Japanese Patent Application No. 2023-089094 filed on May 30, 2023. The entire content of the priority application is incorporated herein by reference.

BACKGROUND ART

A sewing system including a sewing machine and a terminal apparatus that monitors a status of the sewing machine is known.

SUMMARY

For example, a sewing machine of an embroidery status monitoring system includes a temporary storage that stores embroidery data that is being embroidered, and a first data converter that converts the embroidery data into a unique code. An embroidery status monitoring apparatus includes a temporary storage for storing embroidery data that is being embroidered by a sewing machine and that is transferred via a wireless network, a second data converter for converting the embroidery data stored in the temporary storage into a unique code, and a data comparator. The data comparator compares the codes converted by the first data converter and the second data converter. The embroidery status monitoring apparatus requests status data when the codes converted by the first data converter and the second data converter are the same. The embroidery status monitoring apparatus requests embroidery data when the codes converted by the first data converter and the second data converter are different.

In the above-mentioned system, a case where embroidery data is transmitted from the apparatus to the sewing machine is not assumed. Thus, in the above-mentioned system, in a case where a restart of the sewing machine is required such as when a user unexpectedly removes a power cord of the sewing machine while an embroidery pattern is being sewn by the sewing machine based on embroidery data transmitted from the apparatus to the sewing machine, sewing of the embroidery pattern cannot be resumed.

In view of the foregoing, an example of an object of this disclosure is to provide a sewing system, a storage medium storing a monitoring program, and a sewing machine that improve convenience when a restart of the sewing machine is required while an embroidery pattern is being sewn by the sewing machine in a system that sews the embroidery pattern by the sewing machine in accordance with sewing data wirelessly transmitted from a terminal apparatus.

According to a first aspect, this specification discloses a sewing system. The sewing system includes a sewing machine and a terminal apparatus. The sewing machine includes a needle bar, a nonvolatile sewing machine memory, a sewing machine communication interface, and a sewing machine controller. The terminal apparatus includes a terminal controller and a terminal communication interface configured to communicate with the sewing machine. The terminal controller is configured to acquire sewing data including needle position data indicating needle positions for sewing an embroidery pattern by the sewing machine. The terminal controller is configured to transmit the sewing data to the sewing machine via the terminal communication interface. Thus, the terminal apparatus transmits the sewing data to the sewing machine. The sewing machine controller is configured to receive the sewing data transmitted from the terminal apparatus via the sewing machine communication interface. The sewing machine controller is configured to, in response to receiving the sewing data, store first pattern information corresponding to the sewing data in the sewing machine memory. The sewing machine controller is configured to perform a sewing control operation of driving the needle bar to sew the embroidery pattern based on the sewing data. The sewing machine controller is configured to, when the sewing machine is started, determine whether the sewing machine has stopped during execution of the sewing control operation and has restarted. Thus, the sewing machine determines whether the sewing machine has stopped during execution of the sewing control operation and has restarted. The terminal controller is configured to, in a case where it is determined that the sewing machine has stopped during execution of the sewing control operation and has restarted and that the first pattern information stored in the sewing machine memory of the restarted sewing machine corresponds to the sewing data transmitted from the terminal apparatus to the sewing machine before restart of the sewing machine, transmit restoration data to the sewing machine via the terminal communication interface. The restoration data is data corresponding to the sewing data. Thus, the terminal apparatus transmits the restoration data to the sewing machine. The sewing machine controller is configured to, in response to receiving the restoration data from the terminal apparatus via the sewing machine communication interface, drive the needle bar to resume the sewing control operation based on the restoration data. Thus, the sewing machine resumes sewing based on the restoration data. The sewing machine of the sewing system of the first aspect contributes to resuming sewing of the embroidery pattern based on the restoration data transmitted from the terminal apparatus in a case where the sewing machine is restarted while the embroidery pattern is being sewn by the sewing machine. The terminal apparatus of the sewing system transmits the restoration data to the sewing machine when the first pattern information stored in the sewing-machine memory of the restarted sewing machine corresponds to the sewing data transmitted to the sewing machine by the terminal apparatus before the restart. This contributes to avoiding erroneous transmission of the restoration data to an unintended sewing machine such as another sewing machine that does not need to resume sewing.

According to a second aspect, this specification also discloses a non-transitory computer-readable storage medium storing a monitoring program including a set of program instructions for a terminal apparatus including a controller and a communication interface configured to communicate with a sewing machine. The set of program instructions, when executed by the controller, causing the terminal apparatus to perform: acquiring sewing data including needle position data indicating needle positions for sewing an embroidery pattern by the sewing machine; transmitting the sewing data to the sewing machine via the communication interface; and in a case where it is determined that the sewing machine has stopped during sewing of the embroidery pattern based on the sewing data and has restarted and that first pattern information stored in a nonvolatile memory of the sewing machine corresponds to the sewing data transmitted from the terminal apparatus to the sewing machine, transmitting restoration data to the sewing machine via the communication interface, the restoration data being data corresponding to the sewing data. The monitoring program of the second aspect contributes to resuming the sewing of the embroidery pattern by the sewing machine after restart by causing the controller of the terminal apparatus to transmit the restoration data corresponding to the sewing data to the sewing machine in a case where the sewing machine is restarted while the embroidery pattern is being sewn by the sewing machine. The monitoring program according to the second aspect includes a command to cause the sewing machine to transmit the restoration data in a case where the first pattern information stored in the sewing-machine memory of the restarted sewing machine corresponds to the sewing data transmitted to the sewing machine by the terminal apparatus before the restart. This contributes to avoiding erroneous transmission of the restoration data to an unintended sewing machine such as another sewing machine that does not need to resume sewing.

According to a third aspect, this specification also discloses a sewing machine. The sewing machine includes a needle bar, a communication interface, and a controller. The communication interface is configured to communicate with a terminal apparatus. The controller is configured to receive sewing data transmitted from the terminal apparatus via the communication interface. The sewing data includes needle position data indicating needle positions for sewing an embroidery pattern. Thus, the sewing machine receives the sewing data from the terminal apparatus. The controller is configured to perform a sewing control operation of driving the needle bar to sew the embroidery pattern based on the sewing data. Thus, the sewing machine sews the embroidery pattern based on the sewing data. The controller is configured to, in response to determining that the sewing machine has stopped during execution of the sewing control operation and has restarted and in response to receiving restoration data corresponding to the sewing data from the terminal apparatus via the communication interface, drive the needle bar to resume the sewing control operation based on the restoration data. Thus, the sewing machine resumes sewing based on the restoration data. The sewing machine of the third aspect contributes to resuming sewing of the embroidery pattern based on the restoration data transmitted from the terminal apparatus in a case where the sewing machine is restarted while the embroidery pattern is being sewn by the sewing machine.

DESCRIPTION

Figure 1:
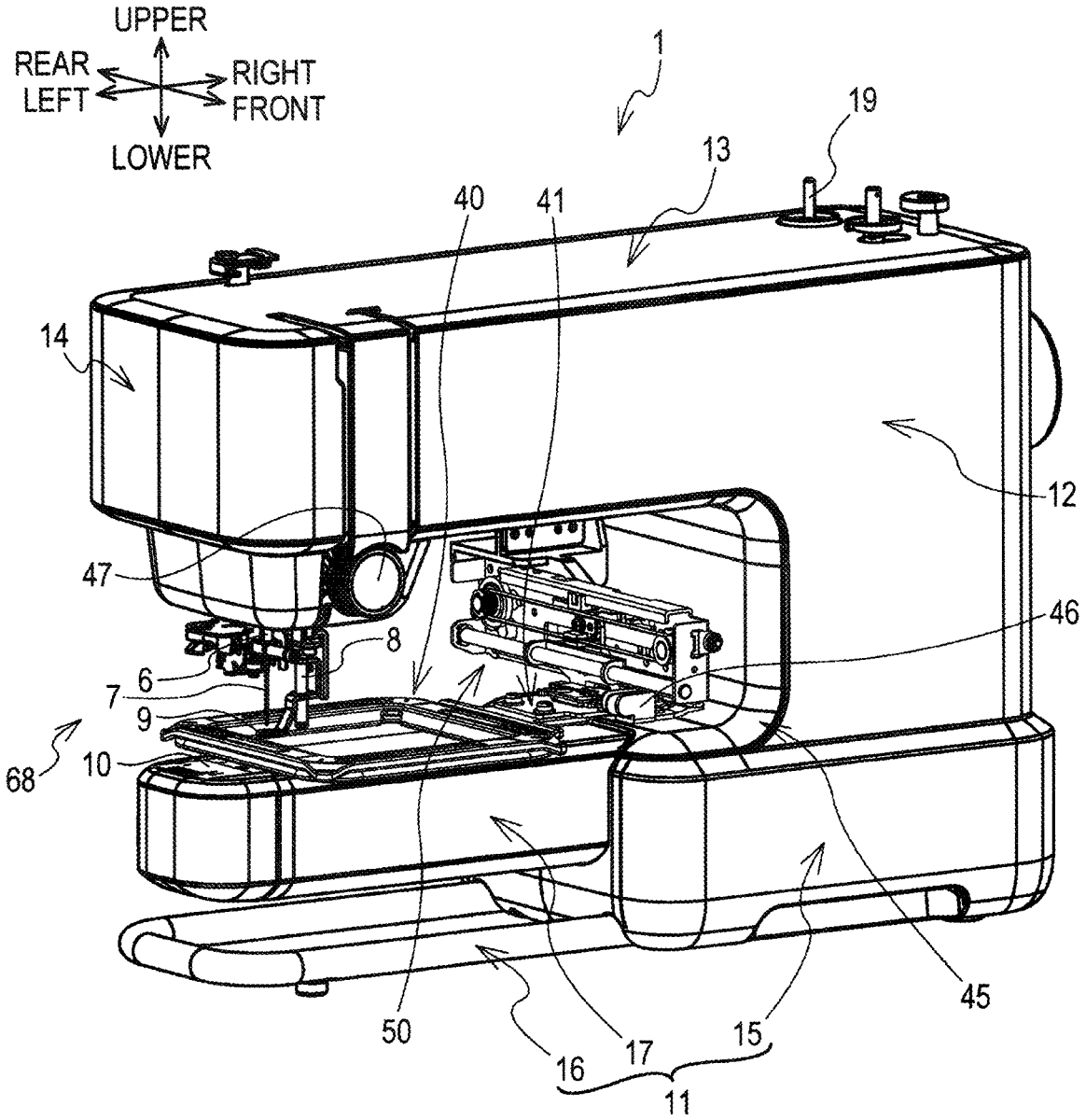
FIG. 1 is a perspective view of a sewing machine 1.

An embodiment of the present disclosure will be described while referring to the drawings. Referring to FIG. 1, a configuration of a sewing system 4 (hereinafter, referred to as "system 4") of the present embodiment will be described. An upper side, a lower side, a lower right side, an upper left side, a lower left side, and an upper right side in FIG. 1 are an upper side, a lower side, a front side, a rear side, a left side, and a right side of a sewing machine 1, respectively. The longitudinal direction of a bed 11 and an arm 13 is a left-right direction of the sewing machine 1. The side on which a column 12 is disposed is the right side. The extending direction of the column 12 is an upper-lower direction of the sewing machine 1.

As shown in FIG. 1, the sewing machine 1 includes the bed 11, the column 12, the arm 13, a head 14, and a carriage 50. The bed 11 is a base portion of the sewing machine 1 that extends in the left-right direction. The bed 11 includes a base portion 15, a foot portion 16, and a free arm portion 17. The base portion 15 is a portion on the right side of a substantial center of the bed 11 in the left-right direction. The base portion 15 includes a sewing machine motor 76 (refer to FIG. 2) therein. The foot portion 16 is a U-shaped round rod-like portion whose right side is opened in a plan view, and right ends of the foot portion 16 are connected to a lower portion of a left end of the base portion 15. The free arm portion 17 is a substantially quadrangular prism-shaped portion extending leftward from an upper portion of the left end of the base portion 15. The sewing machine 1 includes a needle plate 10 on the upper surface of the free arm portion 17, and a hook mechanism (not shown) and so on inside the free arm portion 17. The hook mechanism entwines an upper thread (not shown) with a lower thread (not shown) below the needle plate 10.

The column 12 extends upward from a right end of the bed 11. A spool holder 19 is provided on an upper portion of the column 12. The spool holder 19 holds a thread spool (not shown) around which an upper thread is wound. The arm 13 extends leftward from an upper end of the column 12 in parallel with the bed 11. A main drive shaft (not shown) extending in the left-right direction is provided inside the arm 13. The main drive shaft is rotationally driven by the sewing machine motor 76. The head 14 is connected to the left end of the arm 13. The head 14 is provided with a sewing portion 68 configured to sew an embroidery pattern. The sewing portion 68 includes a needle bar 6, a needle bar mechanism 18 (see FIG. 2), and a presser bar 8. A sewing needle 7 is detachably attached to the lower end of the needle bar 6. A presser foot 9 is detachably attached to the lower end of the presser bar 8. The needle bar 6 is driven in the upper-lower direction by rotation of the main drive shaft.

A movement mechanism 45 includes a holder 46 and the carriage 50, and is configured to move the holder 46 to a position indicated by unique XY coordinate system (embroidery coordinate system). An X direction and a Y direction of the embroidery coordinate system correspond to the left-right direction and the front-rear direction of the sewing machine 1, respectively. The carriage 50 is configured to move a sewing workpiece held by an embroidery frame 40 in the front-rear direction and the left-right direction relative to the needle bar 6. The carriage 50 is supported by a support portion provided inside the arm 13 and is suspended from the arm 13 so as to be movable in the left-right direction. The carriage 50 is configured to move the holder 46 in the front-rear direction.

The embroidery frame 40 is a frame body that holds a sewing workpiece. The sewing workpiece is, for example, a work cloth. The embroidery frame 40 of the present embodiment is substantially square in a plan view, but an embroidery frame having a rectangular shape, a circular shape, or an oval shape may be selected as appropriate in accordance with an embroidery content. The embroidery frame 40 includes, on the right side thereof, a connecting portion 41 for connecting to the holder 46 of the carriage 50.

Figure 2:
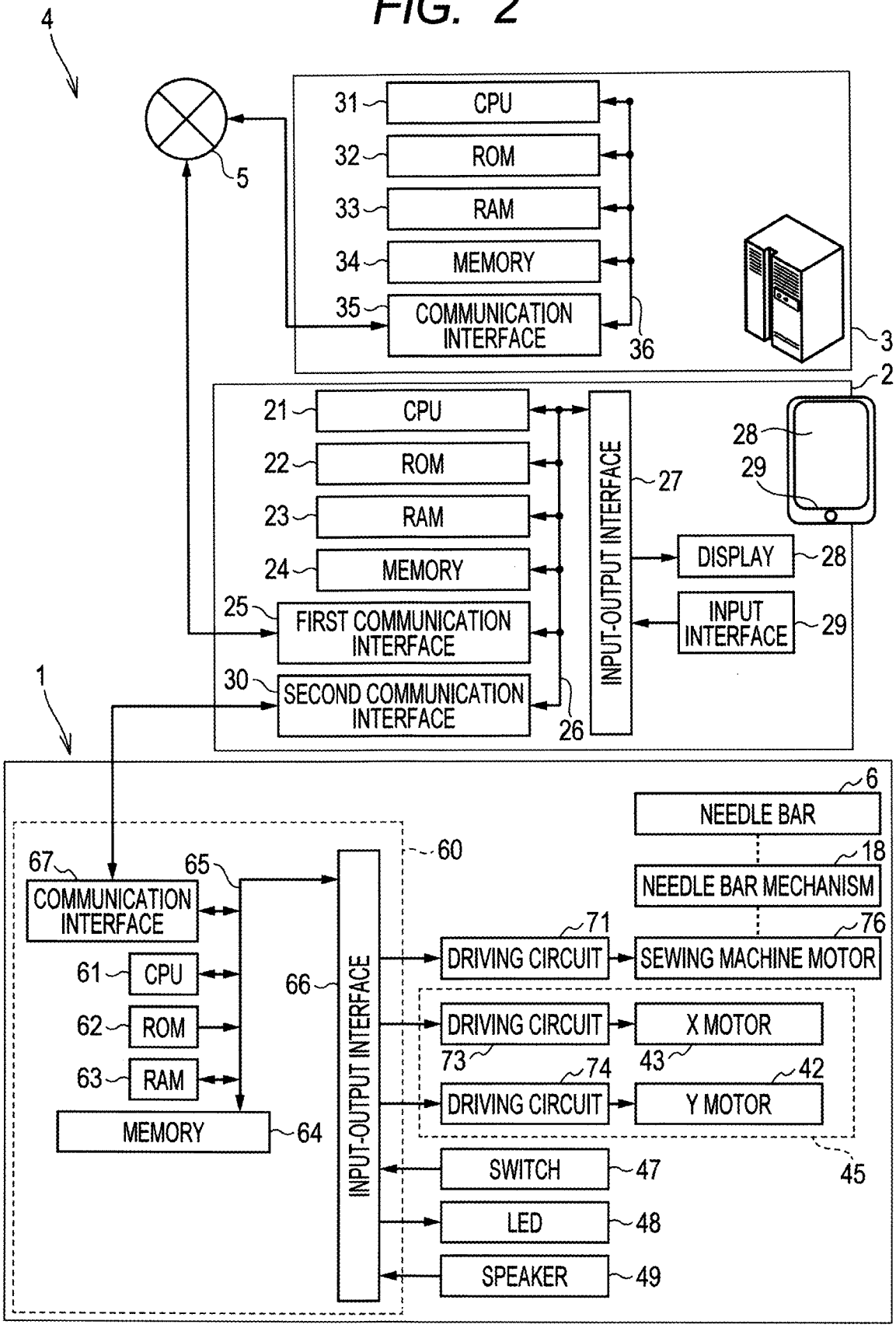
FIG. 2 is a block diagram showing an electrical configuration of a sewing system 4 that includes the sewing machine 1, a terminal apparatus 2, and a server 3.

An electrical configuration of the server 3, the terminal apparatus 2, and the sewing machine 1 included in the system 4 will be described with reference to FIG. 2. The system 4 is configured such that an embroidery pattern is sewn by the sewing machine 1 based on sewing data selected by the terminal apparatus 2 using a web application provided by the server 3.

The server 3 includes a CPU 31, a ROM 32, a RAM 33, a memory 34, and a communication interface 35. The CPU 31 controls the server 3. The CPU 31 is electrically connected to the ROM 32, the RAM 33, the memory 34, and the communication interface 35 via a bus 36. The ROM 32 stores a boot program, a BIOS, and so on. The RAM 33 stores temporary data. The memory 34 is a nonvolatile memory such as an HDD or an SSD. The communication interface 35 is an interface for connecting the server 3 to a network 5. The CPU 31 performs data transmission and reception with another apparatus (for example, the terminal apparatus 2) connected to the network 5 via the communication interface 35.

The terminal apparatus 2 includes a CPU 21, a ROM 22, a RAM 23, a memory 24, a first communication interface 25, a second communication interface 30, and an input-output interface 27. The CPU 21 controls the terminal apparatus 2. The CPU 21 is electrically connected to the ROM 22, the RAM 23, the memory 24, the first communication interface 25, the second communication interface 30, and the input-output interface 27 via a bus 26. The ROM 22 stores a boot program, a BIOS, and so on. The RAM 23 stores temporary data. The memory 24 is a nonvolatile memory. The memory 24 stores various setting values necessary for performing a terminal process described later. The first communication interface 25 is an interface for connecting the terminal apparatus 2 to the network 5. The CPU 21 performs data transmission and reception with another apparatus (for example, the server 3) connected to the network 5 via the first communication interface 25. The second communication interface 30 is an interface for connecting the terminal apparatus 2 to the sewing machine 1. The second communication interface 30 is an interface of a different type from the first communication interface 25, and is an interface of a near field communication standard such as Bluetooth. The "Bluetooth" is a registered trademark of Bluetooth SIG, Inc. The input-output interface 27 is connected to a display 28 and an input interface 29. The display 28 is, for example, a liquid crystal display. The input interface 29 is, for example, a touch screen, and is used when various instructions are input.

A controller 60 of the sewing machine 1 includes a CPU 61, a ROM 62, a RAM 63, a memory 64, an input-output interface 66, and a communication interface 67. The CPU 61 is connected to the ROM 62, the RAM 63, the memory 64, the input-output interface 66, and the communication interface 67 via a bus 65. Driving circuits 71, 73, and 74, a switch 47, an LED 48, and a speaker 49 are connected to the input-output interface 66. The memory 64 is a nonvolatile memory. The memory 64 stores various setting values necessary for execution of a sewing machine process described later.

The sewing machine motor 76 is connected to the driving circuit 71. The driving circuit 71 drives the sewing machine motor 76 in accordance with a control signal from the CPU 61. In accordance with the driving of the sewing machine motor 76, the needle bar mechanism 18 is driven via the main drive shaft (not shown) of the sewing machine 1, and the needle bar 6 moves up and down. An X motor 43 is connected to the driving circuit 73. A Y motor 42 is connected to the driving circuit 74. The driving circuit 73 and the driving circuit 74 drive the X motor 43 and the Y motor 42, respectively, in accordance with control signals from the CPU 61. In accordance with the driving of the X motor 43 and the Y motor 42, the embroidery frame 40 mounted on the movement mechanism 45 moves in the left-right direction (X direction) and the front-rear direction (Y direction) by the amount of movement corresponding to the control signal. The communication interface 67 is an interface for connecting the sewing machine 1 to the terminal apparatus 2. The communication interface 67 is an interface of the near field communication standard corresponding to the second communication interface 30 of the terminal apparatus 2. The CPU 61 performs data transmission and reception with the terminal apparatus 2 via the communication interface 67. The switch 47 is used to instruct start or stop of sewing. The LED 48 is disposed inside the switch 47, and notifies an operation status of the sewing machine 1 by blinking, lighting, and light-out patterns. The LED 48 of the present example includes two types of LEDs, red and green. The operation status of the sewing machine 1 includes "stopped", "sewing in progress", and "sewing completed". The speaker 49 outputs sound.

The operation of the sewing machine 1 will be briefly described. In the sewing machine 1, the needle bar mechanism 18 and the hook mechanism are driven in conjunction with the movement of the embroidery frame 40 in the X direction and the Y direction by the movement mechanism 45. In this way, an embroidery pattern is sewn on the sewing workpiece held by the embroidery frame 40 by the sewing needle 7 attached to the needle bar 6.

Figure 3A:
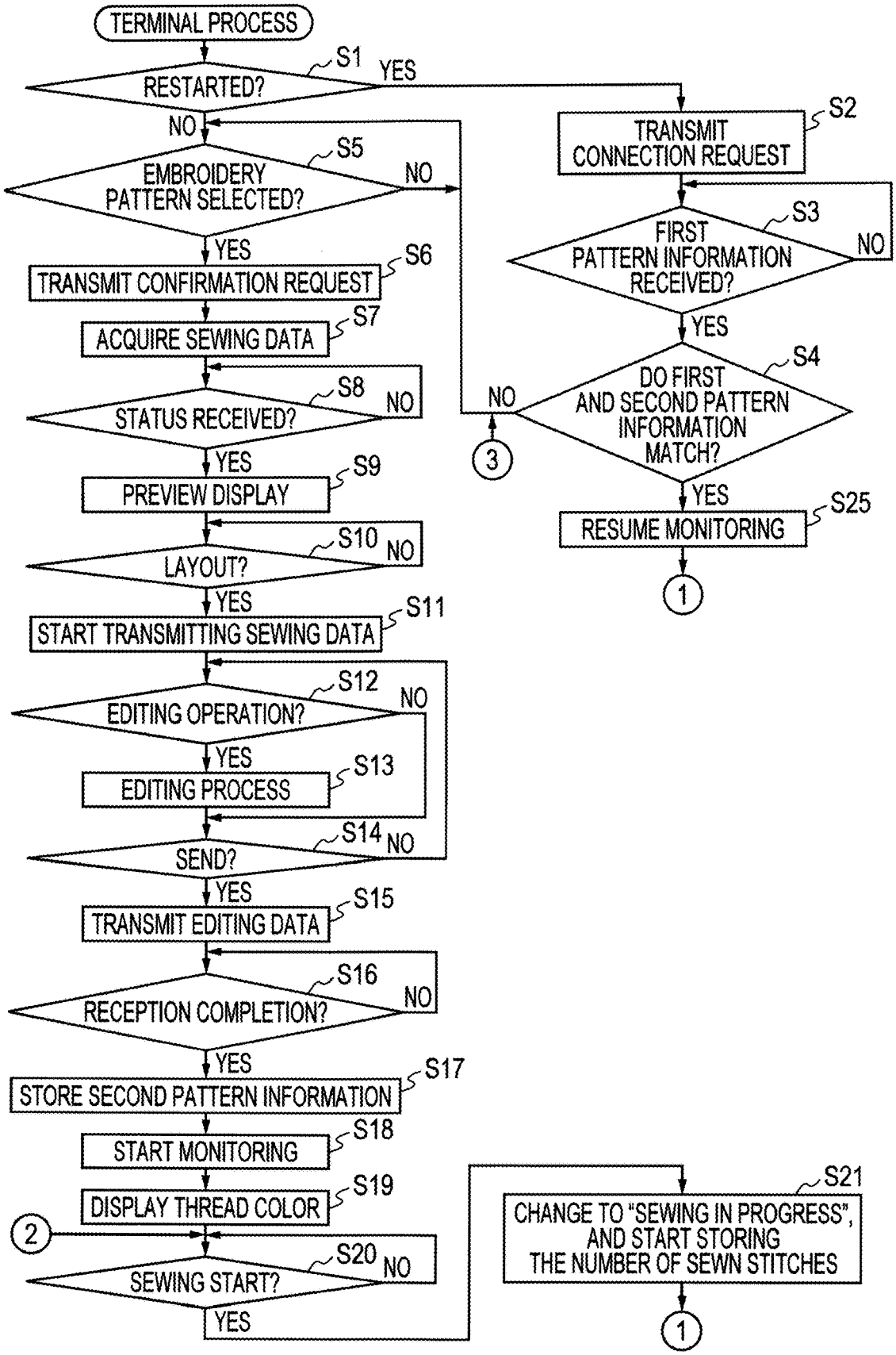
FIGS. 3A and 3B show a flowchart of a terminal process performed by the sewing system 4.
Figure 3B:
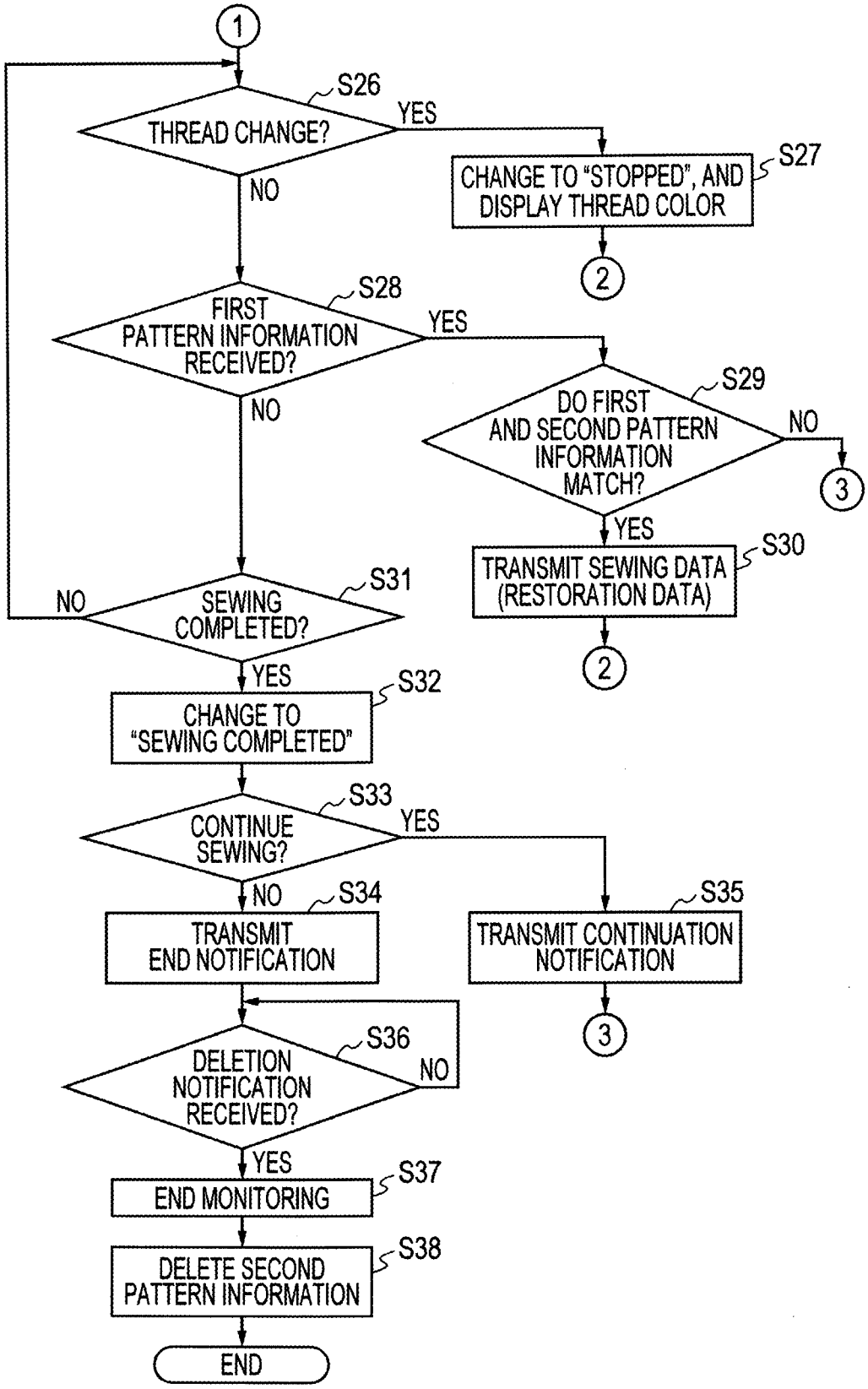
Figure 4:
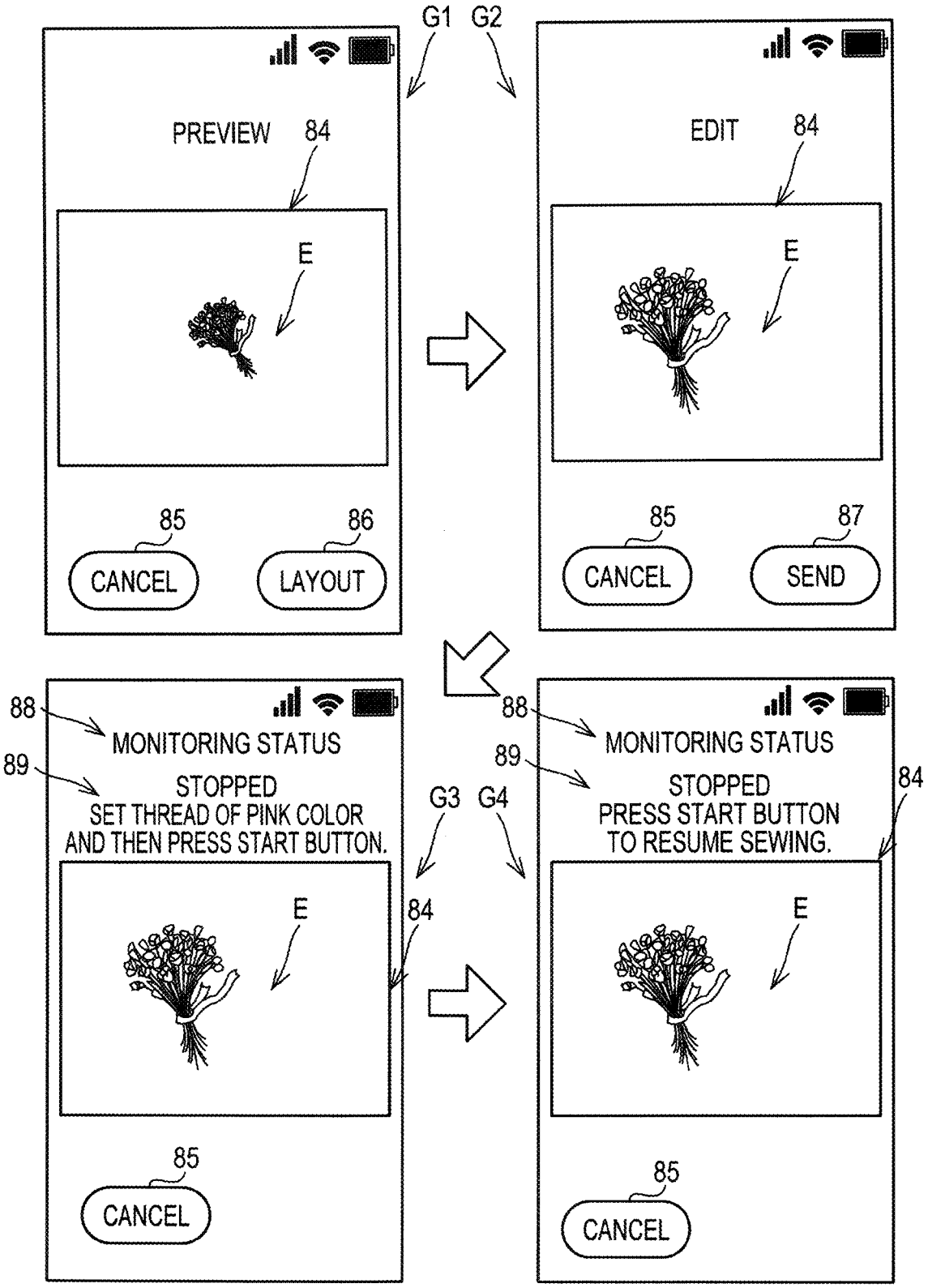
FIG. 4 is an explanatory diagram of transition from a screen G1 to a screen G4 displayed on a display 28 of the terminal apparatus 2.

With reference to FIGS. 3A to 6B, a terminal process and a sewing machine process will be described in order in which the CPU 21 of the terminal apparatus 2 and the CPU 61 of the sewing machine 1 of the system 4 cooperate to sew an embroidery pattern based on sewing data and editing data. The terminal process shown in FIGS. 3A and 3B is a process performed by the CPU 21 of the terminal apparatus 2. In response to acquiring a starting instruction of the terminal process, the CPU 21 reads out a monitoring program stored in the ROM 22 to the RAM 23, and performs the terminal process. Hereinafter, a step will be abbreviated as "S". As an example, a case where an embroidery pattern E displayed on a screen G1 of FIG. 4 is sewn will be described. The embroidery pattern E is a pattern of a flower bouquet sewn with threads of four colors. The embroidery pattern E of the present example includes four partial patterns that are divided by each thread color. At the stage at which the terminal process and the sewing machine process are started, communication between the terminal apparatus 2 and the sewing machine 1 is already established.

As shown in FIGS. 3A and 3B, when the terminal apparatus 2 is started, the CPU 21 determines whether the terminal process of the terminal apparatus 2 has restarted during execution of a sewing control operation by the sewing machine 1 (S1). When the power of the terminal apparatus 2 is unexpectedly turned off during execution of the terminal process or when the monitoring program for performing the terminal process is unintentionally terminated, the terminal apparatus 2 forcibly terminates the terminal process that is being performed and restarts the terminal process. The starting and restarting of the terminal apparatus 2 here indicate that the terminal apparatus 2 is powered on or that the monitoring program for performing the terminal process is started. When the terminal apparatus 2 is started, in a case where the memory 24 stores second pattern information corresponding to sewing data transmitted to the sewing machine 1, the CPU 21 determines that the terminal process of the terminal apparatus 2 has restarted during execution of the sewing control operation by the sewing machine 1 (S1). As will be described later, the CPU 21 of the present embodiment stores the second pattern information corresponding to sewing data in the memory 24 in a case where the sewing data has been transmitted to the sewing machine 1. The second pattern information of the present example is identification information (ID) of the sewing data. When the CPU 21 is notified from the sewing machine 1 having received the sewing data that sewing based on the sewing data has been completed, the CPU 21 deletes the second pattern information from the memory 24. Thus, in a case where the second pattern information is stored in the memory 24 when the terminal process is started, the CPU 21 determines that the terminal process has restarted in a state where sewing based on the sewing data has not been completed after the CPU 21 has transmitted the sewing data to the sewing machine 1.

In a case where it is not determined that the terminal apparatus 2 has restarted (S1: NO), the CPU 21 displays a plurality of candidates for an embroidery pattern to be sewn by the sewing machine 1 on the display 28, and determines whether the embroidery pattern to be sewn by the sewing machine 1 has been selected from among the plurality of embroidery patterns displayed on the display 28, based on the input result of the input interface 29 (S5). The user inputs, via the input interface 29, an instruction to select a desired embroidery pattern from among the plurality of candidates displayed on the display 28. If the embroidery pattern is not selected (S5: NO), the CPU 21 waits in S5 until the embroidery pattern is selected. In response to detecting an instruction to select the embroidery pattern E (S5: YES), the CPU 21 transmits a confirmation request to the sewing machine 1 (S6). The confirmation request is a request that is transmitted from the terminal apparatus 2 to the sewing machine 1 in order to confirm with the sewing machine 1 whether the sewing machine 1 is in a sewable state. In response to receiving the confirmation request, the CPU 61 of the sewing machine 1 transmits information indicating a status of the sewing machine 1 to the terminal apparatus 2 that transmitted the confirmation request. The information indicating the status of the sewing machine 1 is, for example, information indicating whether the sewing machine 1 is in a sewable state.

Figure 5:
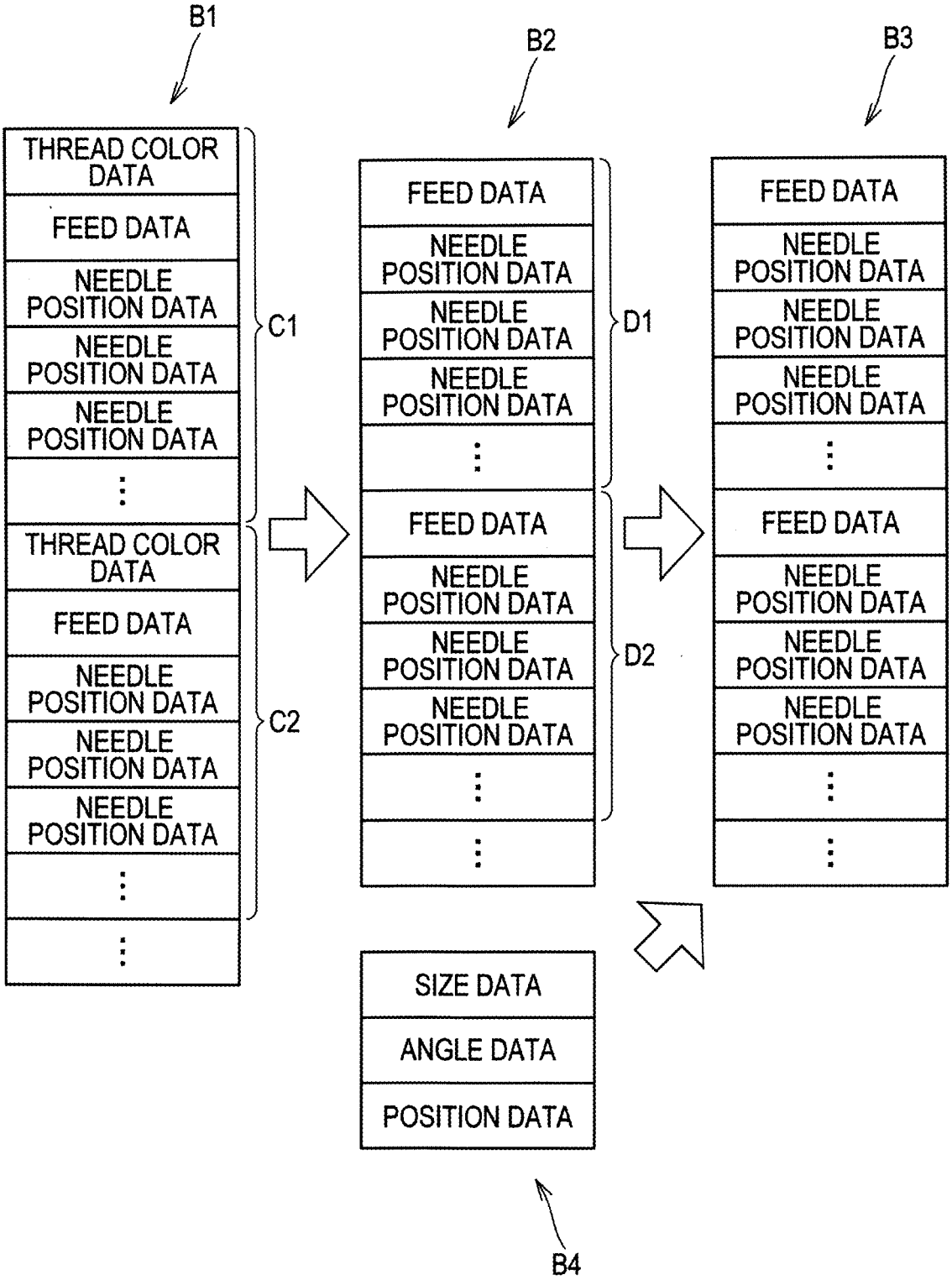
FIG. 5 is an explanatory diagram of sewing data B1 and B2, correction data B3, and editing data B4.

The CPU 21 acquires sewing data including needle position data indicating needle positions in a case where the embroidery pattern E selected in S5 is sewn using the sewing machine 1 (S7). As shown in FIG. 5, sewing data B1 includes a plurality of partial sewing data for sewing partial patterns that are divided for each thread color. The plurality of partial sewing data are stored in the sewing order. Each of the plurality of partial sewing data including partial sewing data C1 and C2 includes thread color data, feed data, and needle position data. The thread color data indicates the color of the thread for sewing the embroidery pattern E. The feed data is data indicating the sewing start position of the partial pattern by coordinates of the embroidery coordinate system. The needle position data is data indicating a position of a needle fall point by the coordinates of the embroidery coordinate system, and includes data group representing a plurality of coordinates for respective needle fall points. The sewing data may be data stored in the memory 24 of the terminal apparatus 2, or may be data acquired from the server 3 in response to selection of the embroidery pattern E in S5.

The CPU 21 waits until information indicating the status of the sewing machine 1 transmitted from the sewing machine 1 is received (S8: NO). In response to receiving the information indicating the status of the sewing machine 1 (S8: YES), the CPU 21 displays the screen G1 on the display 28 as a preview display (S9). The screen G1 includes a field 84 and keys 85 and 86. The field 84 displays a sewing image in a case where the embroidery pattern E selected in S5 is sewn by the sewing machine 1. The size and the shape of the field 84 correspond to the size and the shape of a sewing area that is set inside the embroidery frame 40 that is to be used by the sewing machine 1. The size and the shape of the sewing area may be input by the user or may be acquired from the sewing machine 1. The left-right direction and the upper-lower direction of the screen G1 correspond to the X direction and the Y direction of the embroidery coordinate system, respectively. The arrangement of the embroidery pattern E in the field 84 represents the arrangement of the embroidery pattern E in the sewing area in a case where the embroidery pattern E is sewn by the sewing machine 1. The key 85 is selected when cancelling selection of the embroidery pattern E. The key 86 is selected when editing the arrangement of the selected embroidery pattern E, such as the size, angle, and position of the selected embroidery pattern E, which is displayed in the field 84.

The CPU 21 waits until selection of the key 86 is detected (S10: NO). In response to detecting selection of the key 86 (S10: YES), the CPU 21 starts a process to transmit the selected sewing data to the sewing machine 1 (S11). The CPU 21 transmits at least a portion of the sewing data to the sewing machine 1 before a process of receiving an editing operation in S12 is finished. The CPU 21 of the present example transmits sewing data B2 including the needle position data among the sewing data B1 acquired in S7 to the sewing machine 1, and does not transmit the thread color data to the sewing machine 1. The sewing data B2 includes a plurality of partial sewing data including partial sewing data D1 and D2. The sewing data B2 does not include the thread color data, but includes the feed data and the needle position data.

After starting execution of the process of S11, the CPU 21 displays a screen G2 on the display 28 and starts receiving an editing operation to edit the embroidery pattern E on the input interface 29 (S12). The screen G2 includes the field 84, the key 85, and a key 87. The key 87 is selected when inputting an instruction to transfer editing data that represents the arrangement of the embroidery pattern E to the sewing machine 1. The user inputs an instruction to edit the arrangement of the embroidery pattern E in the field 84. The screen G2 shows the embroidery pattern E after the editing operation. The CPU 21 of the present example receives the editing operation of the arrangement such as the size, the angle, and the position of the embroidery pattern E. The editing operation of the size of the embroidery pattern E is realized by, for example, a pinch operation of pinching the input interface 29 with two fingers of the user. The editing operation of the angle and the position of the embroidery pattern E is realized by, for example, an operation of swiping the input interface 29 with a finger of the user. In a specific example, in response to detecting an editing operation to edit the size, angle, and position of the embroidery pattern E based on the user's operation to enlarge the size of the embroidery pattern E by 1.7 times, rotate the angle of the embroidery pattern E clockwise by 20 degrees, and move the embroidery pattern E leftward (S12: YES), the CPU 21 acquires editing data corresponding to the editing operation, edits the embroidery pattern E based on the editing data, and updates the embroidery pattern E displayed in the field 84 of the display 28 as shown in the screen G2 (S13).

As shown in FIG. 5, editing data B4 of the specific example includes size data indicating the size of the embroidery pattern E, angle data indicating the angle of the embroidery pattern E with respect to a reference angle, and position data indicating the position of the embroidery pattern E with respect to a reference position. The reference angle and the reference position may be relative references or absolute references. For example, the reference angle may be an initial angle of the embroidery pattern E indicated by the sewing data that is acquired in S7. The reference position may be an initial position of the embroidery pattern E that is indicated by the sewing data acquired in S7.

In a case where the editing operation is not detected (S12: NO) or the editing process is performed in S13, the CPU 21 determines whether selection of the key 87 is detected (S14). In response to not detecting selection of the key 87 (S14: NO), the CPU 21 returns the processing to S12. In response to detecting selection of the key 87 (S14: YES), the CPU 21 transmits the editing data B4 that has been acquired in S13 to the sewing machine 1 (S15).

The CPU 21 of the terminal apparatus 2 waits until a reception completion notification is received from the sewing machine 1 (S16: NO). The reception completion notification is transmitted from the sewing machine 1 to the terminal apparatus 2 when reception of the sewing data B2 and the editing data B4 is completed at the sewing machine 1. In response to receiving the reception completion notification from the sewing machine 1 (S16: YES), the CPU 21 stores, in the memory 24, second pattern information which corresponds to the sewing data that has been transmitted to the sewing machine 1 in S11 (S17). The CPU 21 starts a process of displaying a monitoring status of the sewing machine 1 on the display 28 (S18), and displays, on the display 28, a message 89 prompting the user to attach, to the sewing machine 1, a thread of the thread color of the partial pattern that is first in the sewing order among the partial patterns of the embroidery pattern E, based on the sewing data acquired in S7 (S19). As shown in FIG. 4, a screen G3 includes a monitoring status 88, the message 89, the field 84, and the key 85. The monitoring status 88 is displayed based on an execution status transmitted from the sewing machine 1. The message 89 is a message that prompts the user to change the thread, and that is displayed based on the notification from the sewing machine 1 and on the thread color data that is included in the sewing data acquired in S7.

The CPU 21 of the terminal apparatus 2 waits until a sewing start notification is received from the sewing machine 1 (S20: NO). In response to receiving the sewing start notification (S20: YES), the CPU 21 changes the monitoring status displayed on the display 28 to "sewing in progress" (S21). Further, the CPU 21 starts storing the number of sewn stitches transmitted from the sewing machine 1.

The CPU 21 of the terminal apparatus 2 determines whether a thread change notification has been received from the sewing machine 1 (S26). In response to receiving the thread change notification (S26: YES), the CPU 21 changes the monitoring status displayed on the display 28 to "stopped", and displays, on the display 28, the thread color of the partial pattern to be sewn next in the sewing order based on the sewing data acquired in S7 (S27). The CPU 21 returns the processing to S20. After attaching the thread of the thread color displayed on the display 28 of the terminal apparatus 2 to the sewing machine 1, the user presses the switch 47 to input a sewing instruction and resume sewing. In response to not receiving the thread change notification (S26: NO), the CPU 21 determines whether first pattern information has been received from the sewing machine 1 (S28).

As will be described later, in response to receiving the sewing data transmitted from the terminal apparatus 2, the sewing machine 1 stores the first pattern information corresponding to the received sewing data in the memory 64. The first pattern information may be information corresponding to the sewing data, and in the present example, is identification information (ID) of the sewing data. In response to receiving the first pattern information (S28: YES), the CPU 21 determines whether the first pattern information received from the sewing machine 1 corresponds to the sewing data transmitted from the terminal apparatus 2 to the sewing machine 1 (S29). In the present embodiment, in response to receiving the first pattern information from the sewing machine 1, the CPU 21 determines whether the first pattern information received from the sewing machine 1 matches the second pattern information stored in the memory 24 in S17, thereby determining whether the first pattern information received from the sewing machine 1 corresponds to the sewing data transmitted from the terminal apparatus 2 to the sewing machine 1 (S29).

In response to determining that the first pattern information received from the sewing machine 1 corresponds to the sewing data transmitted from the terminal apparatus 2 to the sewing machine 1 (S29: YES), the CPU 21 transmits restoration data corresponding to the sewing data to the sewing machine 1 via the second communication interface 30 (S30). The restoration data is data necessary for resuming sewing based on the sewing data, and includes a part or all of the sewing data that has been transmitted to the sewing machine 1 in S11. The CPU 21 of the present embodiment transmits the sewing data and the editing data at different timings. The restoration data may be data obtained by correcting the sewing data based on the editing data, or may be data that individually includes the sewing data and the editing data. The CPU 21 may generate restoration data based on the number of sewn stitches transmitted from the sewing machine 1, such that the restoration data includes the needle position data for sewing the stitches after the number of stitches corresponding to the number of sewn stitches and does not include the needle position data that has been already sewn, among the sewing data transmitted in S11. The number of stitches corresponding to the number of sewn stitches may be the number of sewn stitches that is transmitted from the sewing machine 1, or may be the number of stitches obtained by increasing or decreasing the number of sewn stitches that is transmitted from the sewing machine 1 by a particular amount. The particular amount may be set by the user or may be a value set in advance. The restoration data of the present example is data that individually includes the sewing data and the editing data. Note that the CPU 61 of the sewing machine 1 detects an abnormality or a stop, and the sewing machine motor 76 gradually stops. Thus, although the CPU 61 recognizes that sewing is stopped at a stitch number X, actual sewing may be performed for additional Y stitches. In this case, if the sewing is resumed from the stitch number X, stiches overlap for the additional Y stitches. Thus, by adding Y stiches, the sewing may be resumed from the stitch number X+Y.

After S30, the CPU 21 displays a screen G4 on the display 28, returns the processing to S20, and waits until a notification that sewing has been resumed based on the restoration data is received (S20). The message 89 on the screen G4 is a message that prompts the user to resume the sewing of the embroidery pattern E by the sewing machine 1. After checking the display 28 of the terminal apparatus 2, the user inputs an instruction to resume sewing to the sewing machine 1. In response to determining that the first pattern information received from the sewing machine 1 does not correspond to the sewing data transmitted from the terminal apparatus 2 to the sewing machine 1 (S29: NO), the CPU 21 returns the processing to S5. For example, a case where it is determined that the first pattern information received from the sewing machine 1 does not correspond to the sewing data transmitted from the terminal apparatus 2 to the sewing machine 1 (S29: NO) is a case where the terminal apparatus 2 that is currently performing the terminal process is different from the terminal apparatus 2 that transmitted the sewing data to the sewing machine 1 that transmitted the first pattern information in S28. In this case, the CPU 21 returns to S5 and performs the terminal process with a sewing machine different from the sewing machine 1 to which the sewing data has been transmitted. The CPU 21 may display a message on the display 28 indicating that a new terminal process will be started with a sewing machine different from the sewing machine 1 to which the sewing data has been transmitted, instead of resuming the terminal process that has been interrupted by the restart of the terminal apparatus 2.

In response to not receiving the first pattern information (S28: NO), the CPU 21 determines whether a completion notification indicating that the sewing has been completed has been received from the sewing machine 1 (S31). In response to not receiving the completion notification (S31: NO), the CPU 21 returns the processing to S26. In response to receiving the completion notification (S31: YES), the CPU 21 changes the monitoring status displayed on the display 28 to "sewing completed" (S32). The CPU 21 determines whether to continue sewing (S33). In response to detecting an instruction to continue sewing the embroidery pattern (S33: YES), the CPU 21 transmits, to the sewing machine 1, a continuation notification indicating that the terminal process and the sewing machine process are to be continued (S35), and returns the processing to S5. In response to not detecting an instruction to continue sewing the embroidery pattern (S33: NO), the CPU 21 transmits, to the sewing machine 1, an end notification notifying that the terminal process and the sewing machine process are to be ended (S34).

The CPU 21 waits until a deletion notification is received from the sewing machine 1 (S36: NO). In response to receiving the deletion notification from the sewing machine 1 (S36: YES), the CPU 21 ends the monitoring of the sewing machine 1 (S37), and deletes the second pattern information stored in the memory 24 in S17 (S38). The CPU 21 then ends the terminal process.

At the time of start of the terminal process, in a case where it is determined that the terminal process of the terminal apparatus 2 has restarted during execution of the sewing control operation by the sewing machine 1 (S1: YES), the CPU 21 transmits a connection request to the sewing machine 1 via the second communication interface 30 (S2). The connection request is a request to the sewing machine 1 to transmit the first pattern information stored in the memory 64 of the sewing machine 1 to the terminal apparatus 2. The CPU 21 waits until the first pattern information is received from the sewing machine 1 (S3: NO). In response to receiving the first pattern information from the sewing machine 1 (S3: YES), the CPU 21 determines whether the first pattern information received from the sewing machine 1 corresponds to the sewing data transmitted from the terminal apparatus 2 to the sewing machine 1 (S4). In the same manner as the process of S29, the CPU 21 determines whether the first pattern information received from the sewing machine 1 matches the second pattern information stored in the memory 24, thereby determining whether the first pattern information received from the sewing machine 1 corresponds to the sewing data transmitted from the terminal apparatus 2 to the sewing machine 1 (S4).

In a case where the first pattern information received from the sewing machine 1 does not match the second pattern information stored in the memory 24 (S4: NO), the CPU 21 moves the processing to S5. This determination is made, for example, in a case where it is determined that the terminal process of the terminal apparatus 2 has restarted during execution of the sewing control operation by the sewing machine 1, but the sewing machine 1 that has transmitted the first pattern information is different from the sewing machine 1 to which the terminal apparatus 2 has transmitted the sewing data before the restart of the terminal apparatus 2. In a case where it is determined that the terminal apparatus 2 has restarted (S1: YES) and the first pattern information stored in the memory 64 corresponds to the sewing data transmitted from the terminal apparatus 2 to the sewing machine 1 (S4: YES), the CPU 21 resumes the monitoring, and resumes the process of displaying the execution status transmitted from the sewing machine 1 on the display 28 (S25). The CPU 21 of the present example displays, on the display 28, the number of sewn stitches transmitted from the sewing machine 1 as the execution status. For example, based on the number of sewn stitches that has been transmitted as the execution status, the CPU 21 displays the number of stitches that have been sewn at the present time among the number of stitches of the entire embroidery pattern. In this case, the CPU 21 may display the execution status by a numerical value, or may appropriately change the display of the execution status, such as changing the color of a sewn portion of the embroidery pattern E displayed in the field 84 to gray color. The CPU 21 then moves the processing to S26.

The sewing machine process that is performed by the sewing machine 1 will be described with reference to FIGS. 6A and 6B. In response to starting of the sewing machine 1, the CPU 61 reads out a program stored in the ROM 62 to the RAM 63 and performs the sewing machine process.

Figure 6A:
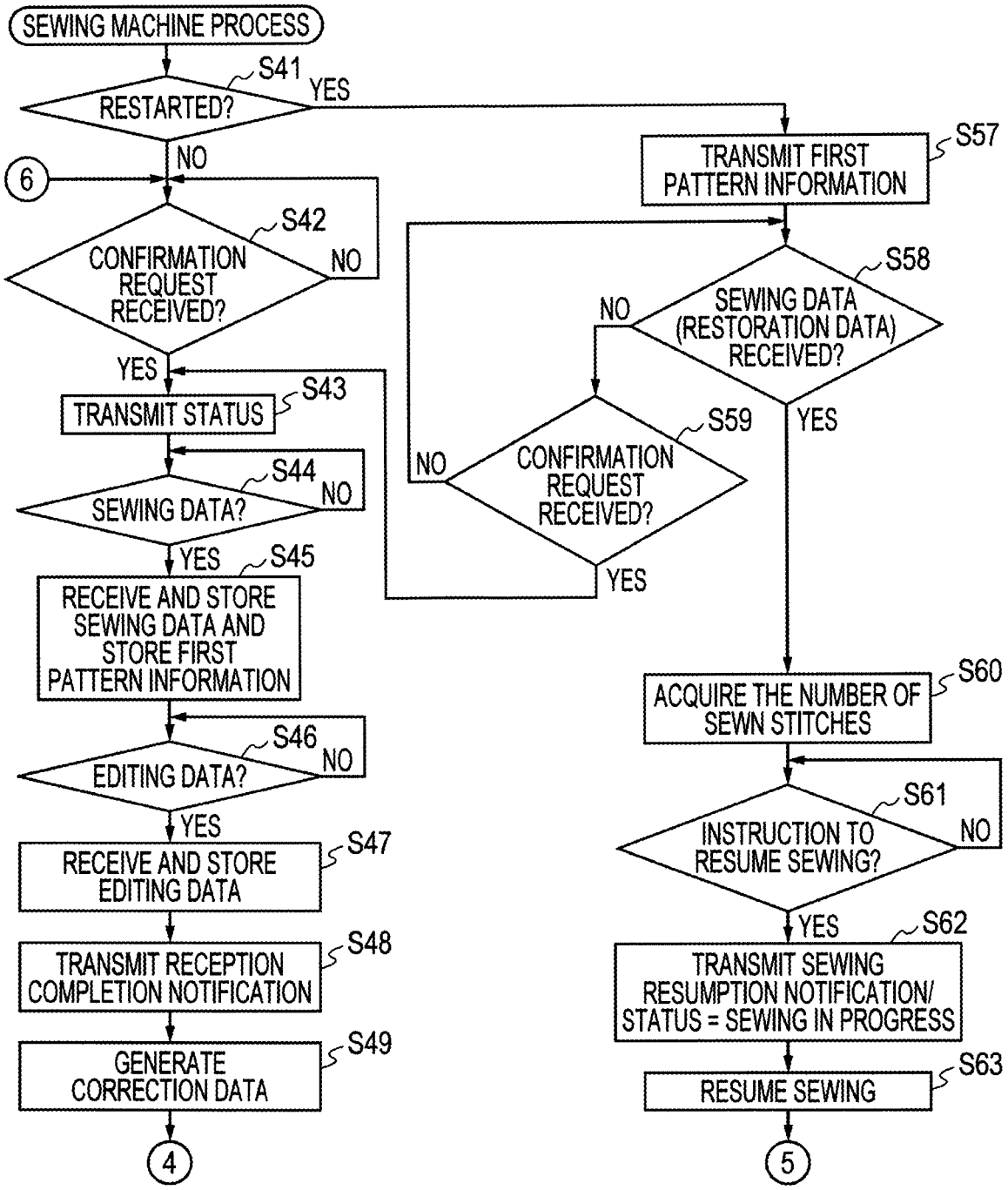
FIGS. 6A and 6B show a flowchart of a sewing machine process performed by the sewing system 4.
Figure 6B:
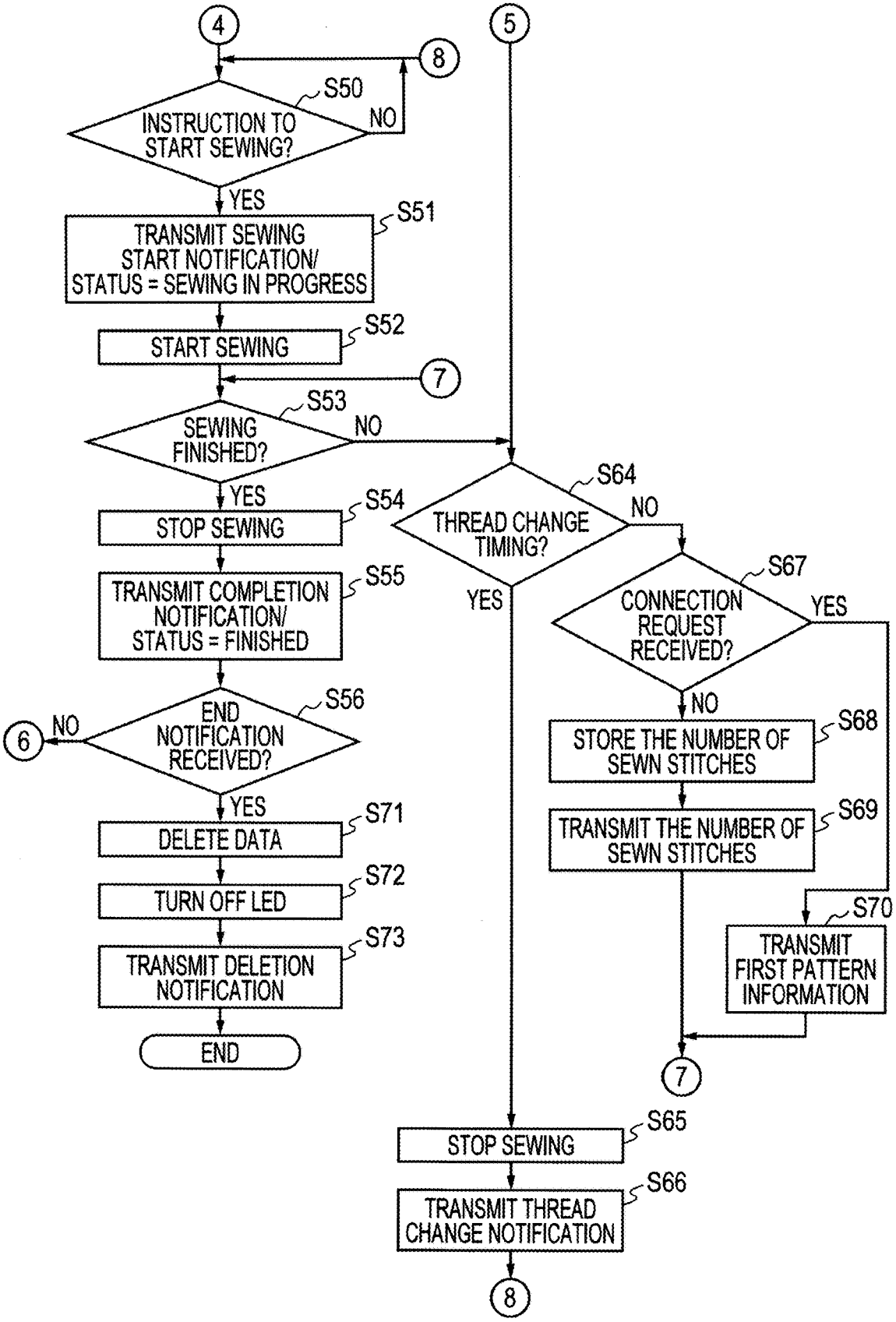
Figure 7A:
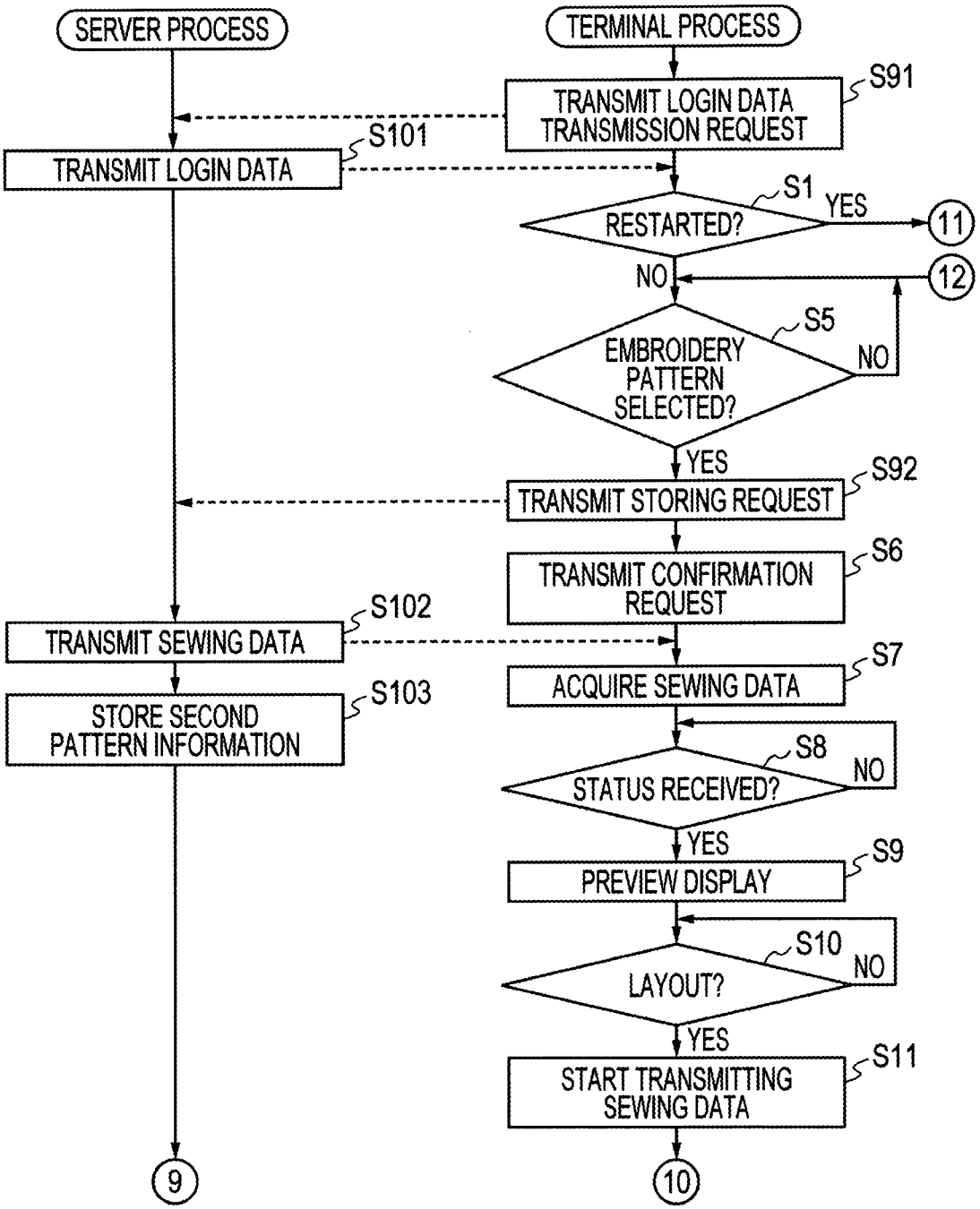
FIGS. 7A and 7B show a part of a flowchart of a server process and a terminal process performed by the sewing system 4.
Figure 7B:
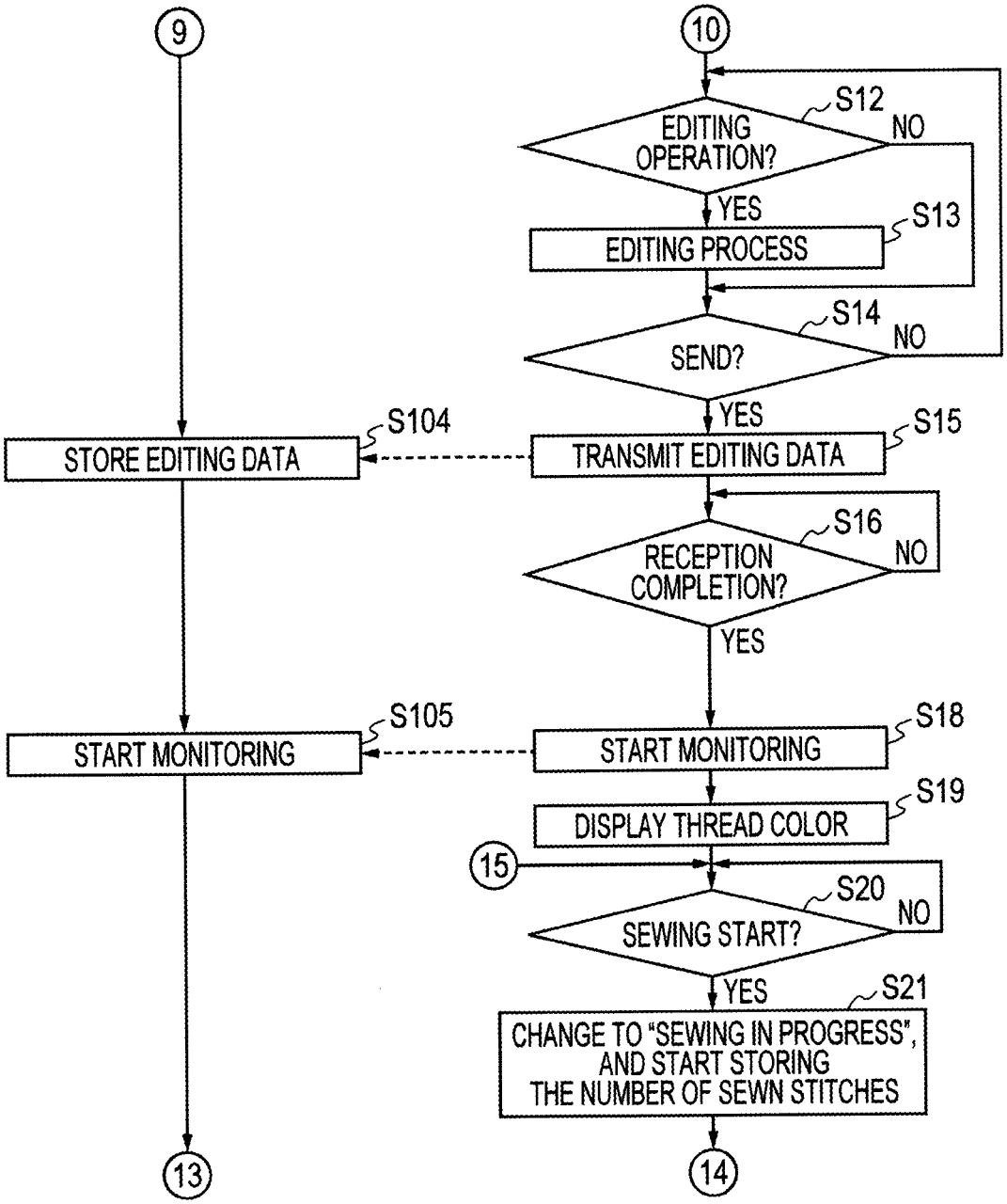

As shown in FIGS. 6A and 6B, when the sewing machine 1 is started, the CPU 61 of the sewing machine 1 determines whether the sewing machine 1 has stopped while the sewing machine 1 is performing a process of sewing an embroidery pattern in accordance with sewing data transmitted from the terminal apparatus 2, and has restarted (S41). In a case where particular information is stored in the nonvolatile memory 64, the CPU 61 determines that the sewing machine 1 has stopped during execution of the sewing control operation and restarted. The particular information may be, for example, a status flag indicating whether the sewing control operation is being performed. In this case, the CPU 61 may perform a process of storing the status flag in the memory 64 as described later (S51, S55, S62). And, in a case where it is determined based on the status flag that the sewing control operation is still being performed at the time of start of the sewing machine 1, the CPU 61 may determine that the sewing machine 1 has stopped during execution of the sewing control operation and restarted (S41: YES). The particular information may be the first pattern information corresponding to the sewing data transmitted from the terminal apparatus 2 and the number of sewn stitches that have been stored during the sewing based on the sewing data. In this case, in a case where the number of sewn stitches and the first pattern information are stored in the memory 64 at the time of start of the sewing machine 1, the CPU 61 may determine that a deletion process (S71) of deleting the number of sewn stitches and the first pattern information has not been performed, and thus determine that the sewing machine 1 has stopped during execution of the sewing control operation and restarted (S41: YES).

In response to not determining that the sewing machine 1 has stopped while the sewing machine 1 is sewing the embroidery pattern E based on the sewing data transmitted from the terminal apparatus 2 and restarted (S41: NO), the CPU 61 waits until the confirmation request transmitted from the terminal apparatus 2 is received (S42: NO). In response to receiving the confirmation request (S42: YES), the CPU 61 transmits the status of the sewing machine 1 to the terminal apparatus 2 that has transmitted the confirmation request (S43). The CPU 61 waits until the CPU 61 detects reception of sewing data transmitted from the CPU 21 of the terminal apparatus 2 (S44: NO). In response to detecting reception of the sewing data (S44: YES), the CPU 61 starts receiving the sewing data and stores the received sewing data in the RAM 63, not in the memory 64 (S45). The CPU 61 stores the first pattern information corresponding to the sewing data received from the terminal apparatus 2 in the memory 64 (S45). In this way, when the power of the sewing machine 1 turns off, the sewing data stored in the RAM 63 disappears. In contrast, even when the power of the sewing machine 1 turns off, the first pattern information is maintained in the state of being stored in the memory 64, and does not disappear. The sewing data received from the terminal apparatus 2 is automatically deleted when the power of the sewing machine 1 turns off, and thus, unnecessary sewing data that has been sewn does not accumulate in the memory 64, and the storage capacity of the memory 64 is not taken up.

The CPU 61 determines whether reception of the editing data from the terminal apparatus 2 is detected (S46). In response to not detecting reception of the editing data (S46: NO), the CPU 61 returns the processing to S46. In response to detecting reception of the editing data B4 shown in FIG. 5 (S46: YES), the CPU 61 receives the editing data B4 and stores the editing data B4 in the RAM 63 (S47). After completing reception of the sewing data B2 and the editing data B4, the CPU 61 responds to the terminal apparatus 2 and transmits a reception completion notification of the sewing data B2 and the editing data B4 to the terminal apparatus 2 (S48). In other words, when reception of the sewing data started in S45 is completed but reception of the editing data is not completed in S47, the CPU 61 does not perform the sewing process in S50 described later until reception of the editing data is completed, and performs the sewing control operation in S52 after reception of both of the sewing data and the editing data is completed. In a case where reception of the sewing data is completed before reception of the editing data is completed, if sewing is started using the sewing data without the editing data, the sewing is not performed appropriately. In the present embodiment, because sewing is performed after completing reception of both the sewing data and the editing data, the sewing that reliably reflects the editing data is performed. The CPU 61 controls the green LED 48 to blink. The blinking of the green LED 48 indicates that the sewing machine 1 is stopped.

The CPU 61 generates correction data B3 by correcting needle position data of the received sewing data B2 based on the editing data B4 received in S47 (S49). In a case where the editing data includes angle data, the CPU 61 generates the correction data for sewing the embroidery pattern E at an angle indicated by the angle data based on the needle position data and the angle data. In a case where the editing data includes position data, the CPU 61 generates the correction data for sewing the embroidery pattern E at a position indicated by the position data based on the needle position data and the position data. In a case where the editing data includes size data, the CPU 61 generates the correction data for sewing the embroidery pattern E of a size indicated by the size data based on the needle position data and the size data. In a case where the editing data includes size data, the CPU 61 may add or delete the needle position data such that the thread density of the corrected embroidery pattern E falls within a particular range. The correction data B3 may be generated separately from the sewing data B2 that is started to be received in S44, or the correction data B3 may be generated by changing the sewing data B2 in accordance with the editing data B4.

The CPU 61 waits until a sewing start instruction is detected (S50: NO). The user attaches a thread of the thread color displayed on the display 28 of the terminal apparatus 2 to the sewing machine 1, and then presses the switch 47 to input the sewing start instruction. In response to detecting the sewing start instruction based on the user's operation (S50: YES), the CPU 61 transmits a sewing start notification to the terminal apparatus 2 (S51). The CPU 61 stores the status flag of "sewing in progress" in the memory 64 (S51).

The CPU 61 of the sewing machine 1 starts a process to sew the embroidery pattern E that has been edited in accordance with the editing operation, based on the sewing data B2 that started to be received in S44 and the editing data B4 that has been received in S47 (S52). The CPU 61 of the present embodiment control the sewing machine 1 to sew the embroidery pattern E based on the correction data B3 generated in S49. In accordance with the needle position data, the CPU 61 drives the movement mechanism 45, the needle bar mechanism 18, and the hook mechanism, and sews the embroidery pattern E on a workpiece held by the embroidery frame 40 with the sewing needle 7 attached to the needle bar 6. The CPU 61 determines whether the sewing is finished based on whether the stitch based on the last needle position data in the sewing order has been formed, among the needle position data of the embroidery pattern E (S53). In response to determining that the sewing is not finished (S53: NO), the CPU 61 determines whether a thread change timing has come, based on whether the stitch based on the last needle position data in the sewing order has been formed, among the needle position data of the partial pattern (S64).

In response to determining that the thread change timing has not come (S64: NO), the CPU 61 determines whether a connection request has been received from the terminal apparatus 2 via the communication interface 67 (S67). In response to receiving the connection request (S67: YES), the CPU 61 transmits the first pattern information stored in the memory 64 to the terminal apparatus 2 that has transmitted the connection request (S70). The CPU 21 returns the processing to S53. In response to not receiving the connection request (S67: NO), the CPU 21 stores the number of sewn stitches in the memory 64 (S68), transmits the number of sewn stitches to the terminal apparatus 2 via the communication interface 67 (S69), and returns the processing to S53. The process of S69 does not need to be performed for each stitch sewing, and may be performed at a particular cycle.

When the thread change timing has come (S64: YES), the CPU 61 stops driving the movement mechanism 45, the needle bar mechanism 18, and the hook mechanism (S65), transmits, to the terminal apparatus 2, a thread change notification notifying that the timing has come to change the thread set on the sewing machine 1 to a thread for sewing the next partial pattern in the sewing order, and turns on the red LED 48 (S66). The lighting of the red LED 48 indicates that the sewing machine 1 is stopped in the middle of sewing due to a thread change and so on. The CPU 61 returns the processing to S50. If the sewing is finished (S53: YES), the CPU 61 stops driving the movement mechanism 45, the needle bar mechanism 18, and the hook mechanism (S54). The CPU 61 transmits, to the terminal apparatus 2, a completion notification notifying that sewing of the embroidery pattern E based on the sewing data started to be received in S44 is completed, and controls the speaker 49 to output a completion buzzer (S55). The CPU 61 controls the green LED 48 to blink.

The CPU 61 of the sewing machine 1 determines whether an end notification has been received or a continuation notification has been received from the terminal apparatus 2 (S56). In response to receiving the continuation notification instead of the end notification (S56: NO), the CPU 61 returns the processing to S42. In response to receiving the end notification (S56: YES), the CPU 61 deletes each of the sewing data started to be received in S44 and stored in the RAM 63 in S45, the editing data received in S46 and stored in the RAM 63, the first pattern information stored in the memory 64 in S45, the status flag stored in the memory 64 in S51, the number of sewn stitches stored in the memory 64 in S68, and the correction data generated in S49 (S71). The CPU 61 turns off the LED 48 (S72), and transmits a deletion notification notifying that the data have been deleted by the process of S71 to the terminal apparatus 2 (S73). The CPU 61 then ends the sewing machine process.

In S41, in response to determining that the sewing machine 1 has restarted (S41: YES), the CPU 61 transmits the first pattern information stored in the memory 64 in S45 to the terminal apparatus 2 via the communication interface 67 (S57). The CPU 61 determines whether sewing data has been received as restoration data (S58). As described above, the restoration data of the present example includes the sewing data and the editing data. In response to not receiving the sewing data (S58: NO), the CPU 61 determines whether the confirmation request has been received (S59). In response to receiving the confirmation request (S59: YES), the CPU 61 moves the processing to S43. In response to not receiving the confirmation request (S59: NO), the CPU 61 returns the processing to S58. In a case where the confirmation request has been received (S59: YES), this is a case where the terminal apparatus 2 has determined that the first pattern information transmitted by the sewing machine 1 does not match the second pattern information stored in the memory 24 of the terminal apparatus 2. That is, this is a case where the first pattern information transmitted by the CPU 61 in S57 has been transmitted to a terminal apparatus different from the terminal apparatus 2 that transmitted the sewing data to the sewing machine 1. In this case, the CPU 61 moves the processing to the S43, and performs a process of sewing a new embroidery pattern E, without performing a process of resuming the sewing of the embroidery pattern E that is interrupted by restart of the sewing machine 1. The CPU 61 may output an error indicating that the process of resuming the sewing of the embroidery pattern E that is interrupted by restart of the sewing machine 1 is not performed. Or, the CPU 61 may transmit a request to output an error to the terminal apparatus 2 and cause the display 28 of the terminal apparatus 2 to display the error.

In response to receiving the sewing data (restoration data) (S58: YES), the CPU 61 acquires the number of sewn stitches that is stored in the memory 64 (S60). The CPU 61 waits until an instruction to resume sewing is input (S61: NO). The user of the sewing machine 1 presses the switch 47 to input an instruction to resume sewing. In response to detecting the instruction to resume sewing (S61: YES), the CPU 61 transmits a sewing resumption notification to the terminal apparatus 2 via the communication interface 67, and stores the status flag having a value "sewing in progress" in the memory 64 (S62). The CPU 61 resumes the sewing of the embroidery pattern E based on the restoration data received in S58 (S63). Here, the term "resume sewing" means that, due to restart of the sewing machine 1, the sewing machine 1 resumes the sewing of the embroidery pattern E in the middle of sewing from a particular position corresponding to the needle position data having the sewing order larger than 1 among the sewing data received in S44 and stored in the RAM 63 in S45, instead of restarting sewing based on the sewing data received in S44 and stored in the RAM 63 in S45 from the beginning. The embroidery pattern sewn before the restart and the embroidery pattern sewn after the restart may partially overlap each other, and the embroidery pattern E is represented as a whole.

The CPU 61 of the present example resumes the sewing of the embroidery pattern E from the number of stitches corresponding to the number of sewn stitches stored in the memory 64. The number of stitches corresponding to the number of sewn stitches may be the number of sewn stitches that is notified from the sewing machine 1, or may be the number of stitches obtained by increasing or decreasing the number of sewn stitches that is notified from the sewing machine 1 by a particular amount. The particular amount may be set by the user or may be a value set in advance. The CPU 61 performs the process of S64 described above. The particular amount is set to a value less than or equal to 10, for example. In this example, since the restoration data received in S58 includes the sewing data B2 and the editing data B4, the CPU 61 resumes the sewing of the embroidery pattern E from the number of stitches corresponding to the number of sewn stitches, based on the correction data B3 generated by the same processing as S49 and the number of sewn stitches. In a case where the restoration data received in S58 includes the needle position data after the number of stitches corresponding to the number of sewn stitches in the sewing order among the correction data B3 and does not include the needle position data before the number of stitches corresponding to the number of sewn stitches, the CPU 61 of the present example may resume the sewing of the embroidery pattern E from the number of stitches corresponding to the number of sewn stitches based on the sewing order of the restoration data. The CPU 61 moves the processing to S64.

In the system 4 of the above-described embodiment, the second pattern information used in the process of determining whether the terminal apparatus 2 or the sewing machine 1 has restarted is stored in the memory 24 of the terminal apparatus 2. However, the second pattern information may be stored in the server 3 that communicates with the terminal apparatus 2. Hereinafter, with reference to FIGS. 7A, 7B, 8A and 8B, a server process and a terminal process in a case where the second pattern information is stored in the server 3 will be described in parallel. In the terminal process shown in FIGS. 7A, 7B, 8A and 8B, the same step numbers are assigned to the same processes as the terminal process in FIGS. 3A and 3B. As shown in FIGS. 7A, 7B, 8A and 8B, the terminal process of the modification differs from the terminal process of FIGS. 3A and 3B in that S17 and S38 are omitted, S91 is performed before S1, S92 is performed between S5 and S6, S93 is performed between S3 and S4, and S94 is performed between S28 and S29. The description of the same processes as the terminal process of FIGS. 3A and 3B will be omitted or simplified. In response to starting of the server 3, the CPU 31 reads a program stored in the ROM 32 to the RAM 33 and performs the server process. In response to restart of the terminal apparatus 2, the CPU 21 reads a program stored in the ROM 22 to the RAM 23 and performs the terminal process. Hereinafter, a step will be abbreviated as "S".

When the terminal process is started, the CPU 21 of the terminal apparatus 2 transmits a login data transmission request to the server 3 (S91). The login data transmission request includes terminal information for identifying the terminal apparatus 2. In response to receiving the login data transmission request from the terminal apparatus 2, the CPU 31 of the server 3 performs a login process for the terminal apparatus 2 and transmits previous login data to the terminal apparatus 2 (S101). The previous login data includes the terminal information, the second pattern information corresponding to the sewing data that has been transmitted from the terminal apparatus 2 to the sewing machine 1, and the status flag indicating whether sewing of the embroidery pattern E based on the sewing data has been finished.

The CPU 21 of the terminal apparatus 2 performs the process of S1 based on the received login data. Specifically, in a case where it is determined based on the login data that the sewing of the embroidery pattern E based on the sewing data transmitted from terminal apparatus 2 to the sewing machine 1 has not been finished, the CPU 21 determines that the terminal process of the terminal apparatus 2 has restarted during execution of the sewing control operation by the sewing machine 1 (S1: YES). In response to detecting an instruction to select the embroidery pattern E in S5 (S5: YES), the CPU 21 transmits, to the server 3, a storing request to store, in the memory 34, the second pattern information corresponding to the sewing data transmitted to the sewing machine 1 in the sewing data transmission process and the terminal information identifying the terminal apparatus 2 in association with each other (S92).

In response to receiving the storing request from the terminal apparatus 2, the CPU 31 of the server 3 transmits sewing data corresponding to the second pattern information to the terminal apparatus 2 (S102), and stores the second pattern information and terminal information of the terminal apparatus 2 in the memory 34 in association with each other (S103). The CPU 21 of the terminal apparatus 2 receives the sewing data transmitted from the server 3 and stores the sewing data in the RAM 23 (S7). That is, in the modification, the terminal apparatus 2 does not need to store the sewing data at the time of selecting the embroidery pattern E in S5. In S15, the CPU 21 transmits editing data to the server 3 in addition to the sewing machine 1 (S15). The CPU 31 of the server 3 receives the editing data transmitted from the terminal apparatus 2, and stores, as a part of the login data, the editing data in the memory 34 in association with the terminal information of the terminal apparatus 2 (S104). In S18, the CPU 21 starts a process to transmit the execution status received from the sewing machine 1 to the server 3 (S18). The CPU 31 of the server 3 receives the execution status transmitted from the terminal apparatus 2, stores, as a part of the login data, the execution status in the memory 34 in association with the terminal information of the terminal apparatus 2, and starts monitoring (S105).

Figure 8A:
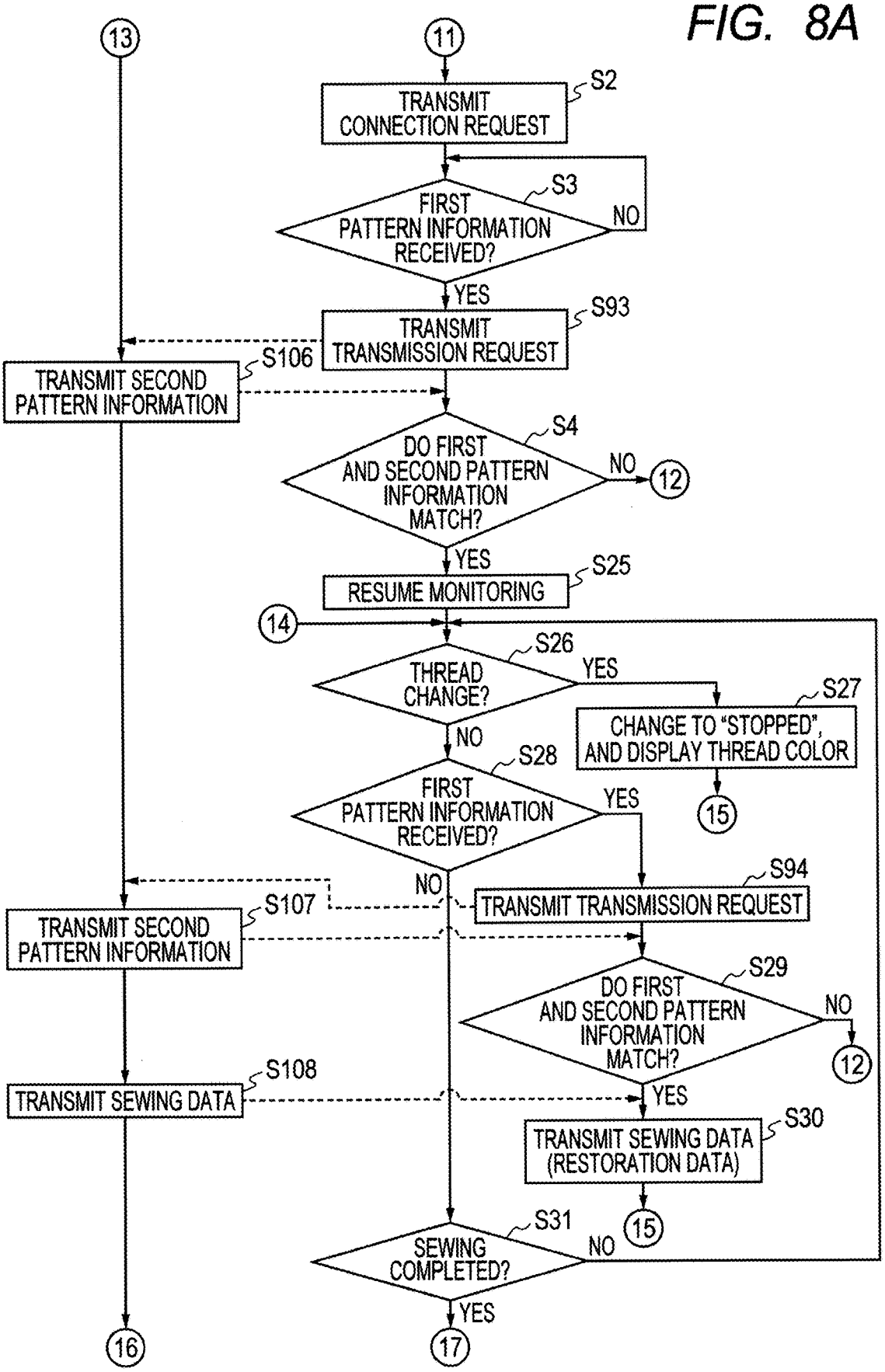
FIGS. 8A and 8B show a remaining part of the flowchart of the server process and the terminal process performed by the sewing system 4.
Figure 8B:
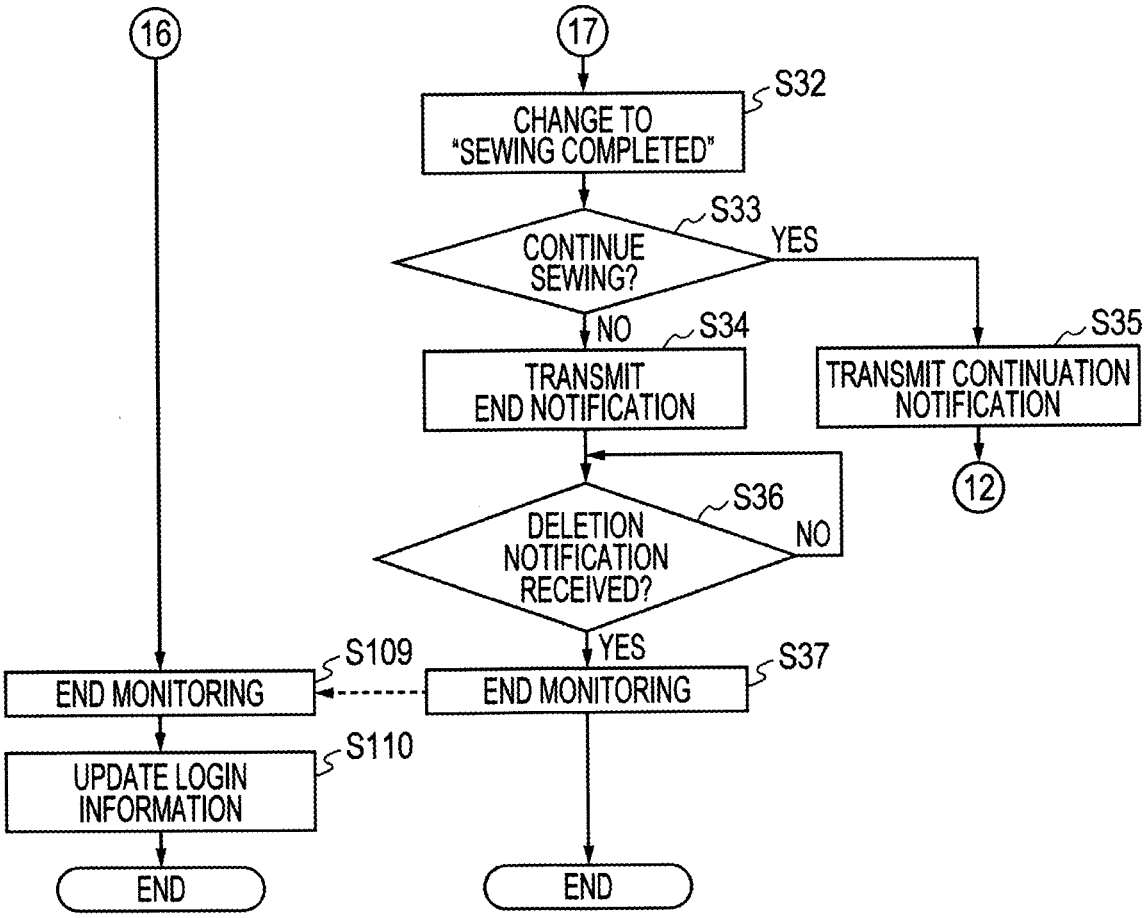

As shown in FIGS. 8A and 8B, in response to determining that the terminal apparatus 2 has restarted and to receiving the first pattern information from the sewing machine 1 (S1: YES, S2, S3: YES), the CPU 21 transmits, to the server 3, a transmission request that requests the server 3 to transmit the second pattern information corresponding to the terminal information of the terminal apparatus 2 to the terminal apparatus 2 (S93). In response to receiving the transmission request from the terminal apparatus 2, the CPU 31 of the server 3 transmits the second pattern information corresponding to the terminal information stored in the memory 34 to the terminal apparatus 2 (S106). In response to receiving the first pattern information from the sewing machine 1, the CPU 21 of the terminal apparatus 2 determines whether the first pattern information received from the sewing machine 1 matches the second pattern information transmitted from the server 3, thereby determining whether the first pattern information received from the sewing machine 1 corresponds to the sewing data transmitted from the terminal apparatus 2 to the sewing machine 1 (S4: YES).

In response to receiving the first pattern information from the sewing machine 1, the CPU 21 transmits, to the server 3, a transmission request that requests the server 3 to transmit the second pattern information corresponding to the terminal information of the terminal apparatus 2 to the terminal apparatus 2 (S94). In response to receiving the transmission request from the terminal apparatus 2, the CPU 31 of the server 3 transmits the second pattern information corresponding to the terminal information stored in the memory 34 to the terminal apparatus 2 (S107). The CPU 21 determines whether the first pattern information received from the sewing machine 1 matches the second pattern information transmitted from the server 3, thereby determining whether the first pattern information received from the sewing machine 1 corresponds to the sewing data transmitted from the terminal apparatus 2 to the sewing machine 1 (S29: YES). The CPU 31 of the server 3 transmits the sewing data and the editing data corresponding to the second pattern information stored in the memory 64 to the terminal apparatus 2 (S108). The CPU 21 of the terminal apparatus 2 receives the sewing data and the editing data transmitted from the server 3, and transmits the received sewing data and editing data to the sewing machine 1 (S30).

The CPU 21 transmits, to the server 3, a notification that monitoring of the sewing machine 1 is to be ended (S37). The CPU 31 of the server 3 having received the notification ends monitoring of the sewing machine 1 that is connected to the terminal apparatus 2 (S109). The CPU 31 updates the login information of the terminal apparatus 2 (S110).

In the above embodiment and modification, the system 4, the sewing machine 1, the terminal apparatus 2, the server 3, the needle bar 6, and the display 28 are examples of a sewing system, a sewing machine, a terminal apparatus, a server, a needle bar, and an output interface. The CPU 21 is an example of a terminal controller and a controller. The CPU 61 is an example of a sewing machine controller and a controller. The memory 64 is an example of a sewing machine memory and a first memory. The RAM 63 is an example of a second memory. The memory 24 is an example of a terminal memory. The communication interface 67 is an example of a sewing machine communication interface and a communication interface. The second communication interface 30 is an example of a terminal communication interface and a communication interface. The process of S7 is an example of an acquisition process. The process of S11 is an example of a sewing data transmission process. The process of S44 is an example of a sewing data receiving process. The process of S45 is an example of a pattern information storing process. The process of S52 is an example of a sewing control operation. The process of S41 is an example of a first determination process. The process of S30 is an example of a restoration data transmission process. The process of S63 is an example of a sewing resumption process. The process of S57 is an example of a pattern information transmission process. The processes of S4 and S29 are examples of a condition determination process. The process of S17 is an example of a terminal storing process. The process of S51 is an example of a flag storing process. The process of S68 is an example of a number-of-stitches storing process. The process of S71 is an example of a deletion process. The process of S92 is an example of a storing request transmission process. The processes of S93 and S94 are examples of a transmission request transmission process. The process of S103 is an example of a server storing process. The processes of S106 and S107 are examples of a server transmission process. The process of S69 is an example of a status transmission process. The process of S1 is an example of a second determination process. The process of S5 is an example of a selection receiving process. The process of S18 is an example of a notification process. The process of S25 is an example of a notification resumption process. The process of S2 is an example of a connection request transmission process. The process of S70 is an example of a connection request response process.

The system 4 of the above embodiment includes the sewing machine 1 including the needle bar 6, the nonvolatile memory 64, the communication interface 67, and the CPU 61, and the terminal apparatus 2 including the CPU 21 and the second communication interface 30 configured to communicate with the sewing machine 1. The CPU 21 of the terminal apparatus 2 acquires the sewing data including the needle position data indicating the needle position in a case where the embroidery pattern is sewn with the sewing machine 1 (S7). The CPU 21 transmits the sewing data to the sewing machine 1 via the second communication interface 30 (S11). The CPU 61 of the sewing machine 1 receives the transmitted sewing data via the communication interface 67 (S44). In response to receiving the sewing data, the CPU 61 stores the first pattern information corresponding to the sewing data in the memory 64 (S45). The CPU 61 drives the needle bar 6 to sew the embroidery pattern based on the sewing data (S52). When the sewing machine 1 is started, the CPU 61 determines whether the sewing machine 1 has stopped during execution of the sewing control operation and restarted (S41). When it is determined that the sewing machine 1 has restarted (S41: YES) and the first pattern information stored in the memory 64 of the restarted sewing machine 1 corresponds to the sewing data transmitted from the terminal apparatus 2 to the sewing machine 1 before restart of the sewing machine 1 (S29: YES), the CPU 21 of the terminal apparatus 2 transmits restoration data corresponding to the sewing data to the sewing machine 1 via the second communication interface 30 (S30). After S41, in response to receiving the restoration data from the terminal apparatus 2 via the communication interface 67, the CPU 61 of the sewing machine 1 drives the needle bar 6 to restart the sewing control operation based on the restoration data (S63). In a case where the sewing machine 1 needs to be restarted while the embroidery pattern is being sewn by the sewing machine 1, the sewing machine 1 of the system 4 resumes the sewing of the embroidery pattern based on the restoration data that has been transmitted from the terminal apparatus 2. In a case where the first pattern information stored in the memory 64 of the restarted sewing machine 1 corresponds to the sewing data transmitted from the terminal apparatus 2 to the sewing machine 1 before the restart, the terminal apparatus 2 transmits the restoration data to the sewing machine 1. This suppresses erroneous transmission of the restoration data to an unintended sewing machine 1, such as another sewing machine 1 that does not need to resume sewing.

In a case where it is determined that the sewing machine 1 has restarted (S41: YES), the CPU 61 of the sewing machine 1 transmits the first pattern information to the terminal apparatus 2 via the communication interface 67 (S57). In response to receiving the first pattern information from the sewing machine 1 via the second communication interface 30 (S28: YES), the CPU 21 of the terminal apparatus 2 determines whether the first pattern information received from the sewing machine 1 corresponds to the sewing data transmitted from the terminal apparatus 2 to the sewing machine 1 (S29). In a case where it is determined in S29 that the first pattern information received from the sewing machine 1 via the second communication interface 30 corresponds to the sewing data transmitted from the terminal apparatus 2 to the sewing machine 1 (S29: YES), the CPU 21 transmits the restoration data to the sewing machine 1 (S30). This enables the terminal apparatus 2 of the system 4 to simplify the processing from when S41 is performed to when the restoration data is transmitted, compared with a case where S29 is performed by the sewing machine 1.

The first pattern information is identification information of the sewing data. This enables the terminal apparatus 2 of the system 4 to relatively simplify the process of S29 compared with a case where the first pattern information is the sewing data itself.

The terminal apparatus 2 includes the memory 24. The CPU 21 of the terminal apparatus 2 stores, in the memory 24, the second pattern information corresponding to the sewing data transmitted to the sewing machine 1 in S11 (S17). In response to receiving the first pattern information from the sewing machine 1, in S29, the CPU 21 determines whether the first pattern information received from the sewing machine 1 matches the second pattern information stored in the memory 24, thereby determining whether the first pattern information received from the sewing machine 1 corresponds to the sewing data transmitted from the terminal apparatus 2 to the sewing machine 1 (S29). This enables the terminal apparatus 2 of the system 4 to relatively simplify the condition determination process, compared with a case where the first pattern information and the second pattern information are the sewing data itself.

The CPU 61 of the sewing machine 1 stores, in the memory 64, the status flag indicating whether the process of S52 is being performed (S51, S55, S62). In a case where it is determined based on the status flag in S41 that the sewing control operation that is started in S52 is being performed when the sewing machine 1 is started, the CPU 61 determines that the sewing machine 1 has stopped during execution of the sewing control operation, and has restarted (S41: YES). This enables the sewing machine 1 of the system 4 to perform the process of S41 relatively easily for determining whether the sewing machine 1 has restarted during execution of the sewing control operation by the sewing machine 1.

The CPU 61 of the sewing machine 1 stores, in the memory 64, the number of sewn stitches that have been sewn based on the sewing data during execution of the sewing control operation that is started in S52 (S68). In the sewing resumption process of S63, after S41, in response to receiving the restoration data, the sewing of the embroidery pattern is restarted based on the restoration data from the number of stitches corresponding to the number of sewn stitches stored in the memory 64 (S63). This enables the sewing machine 1 of the system 4 to resume the sewing of the embroidery pattern from an appropriate stitch number based on the number of sewn stitches stored in the memory 64.

In response to the completion of the sewing control operation that is started in S52, the CPU 61 of the sewing machine 1 deletes the number of sewn stitches and the first pattern information from the memory 64 (S71). In a case where the number of sewn stitches and the first pattern information are stored in the memory 64 at the time of start of the sewing machine 1, the CPU 61 determines that the deletion process has not been performed, and that the sewing machine 1 has stopped during execution of the sewing control operation and restarted (S41: YES). This enables the sewing machine 1 of the system 4 to perform the process of S41 relatively easily for determining whether the sewing machine 1 has restarted during execution of the sewing control operation by the sewing machine 1.

The system 4 of the modification includes the server 3 that communicates with the terminal apparatus 2 and includes the memory 34 and the CPU 31. The CPU 21 of the terminal apparatus 2 transmits a storing request to the server 3 via the first communication interface 25, which is different from the second communication interface 30, the storing request requesting that the second pattern information corresponding to the sewing data transmitted to the sewing machine 1 in S11 and the terminal information identifying the terminal apparatus 2 be stored in the memory 34 in association with each other (S92). In response to receiving the first pattern information from the sewing machine 1, the CPU 21 transmits a transmission request to the server 3 via the first communication interface 25, the transmission request requesting that the second pattern information corresponding to the terminal information of the terminal apparatus 2 be transmitted to the terminal apparatus 2 (S93, S94). In response to receiving the storing request from the terminal apparatus 2, the CPU 31 of the server 3 stores the second pattern information and the terminal information of the terminal apparatus 2 in the memory 34 in association with each other (S103). In response to receiving the transmission request from the terminal apparatus 2, the CPU 31 transmits the second pattern information corresponding to the terminal information stored in the memory 34 to the terminal apparatus 2 via the communication interface 35 (S107). In response to receiving the first pattern information from the sewing machine 1, the CPU 21 of the terminal apparatus 2 determines whether the first pattern information received from the sewing machine 1 matches the second pattern information transmitted from the server 3, thereby determining whether the first pattern information received from the sewing machine 1 corresponds to the sewing data transmitted from the terminal apparatus 2 to the sewing machine 1 (S29: YES). Since the second pattern information is stored in the memory 34 of the server 3, the process of S29 by the terminal apparatus 2 of the system 4 is relatively simplified. In the system 4, even when one terminal apparatus 2 becomes unusable due to some reason such as shortage of electric charge of the terminal apparatus 2, the process of S29 is still performed by using another terminal apparatus 2 capable of communicating with the server 3.

The terminal apparatus 2 of the above embodiment includes the display 28. After receiving the sewing data in S44, the CPU 61 of the sewing machine 1 transmits the execution status of the sewing control operation that is started in S52 to the terminal apparatus 2 via the communication interface 67 (S69). When the terminal apparatus 2 is started, the CPU 21 of the terminal apparatus 2 determines whether the terminal apparatus 2 has restarted during execution of the sewing control operation by the sewing machine 1 (S1). In a case where it is not determined in S1 that the terminal apparatus 2 has restarted (S1: NO), the CPU 21 receives a selection operation to select one of the plurality of embroidery patterns (S5). In S11, the CPU 21 transmits the sewing data of the embroidery pattern selected in S5 to the sewing machine 1 via the second communication interface 30 (S11), and after transmitting the sewing data to the sewing machine 1, notifies (displays) the execution status transmitted by the sewing machine 1 on the display 28 (S18). In a case where it is determined in S1 that the terminal apparatus 2 has restarted (S1: YES) and the first pattern information stored in the memory 64 corresponds to the sewing data transmitted from the terminal apparatus 2 to the sewing machine 1 (S4: YES), the CPU 21 resumes the notification process of notifying (displaying) the execution status transmitted from the sewing machine 1 on the display 28 (S25). In a case where it is determined that the terminal apparatus 2 has restarted and the first pattern information stored in the memory 64 corresponds to the sewing data transmitted from the terminal apparatus 2 to the sewing machine 1, the terminal apparatus 2 of the system 4 resumes reception of the execution status.

In a case where it is determined in S1 that the terminal apparatus 2 has restarted (S1: YES), the CPU 21 of the terminal apparatus 2 transmits a connection request to the sewing machine 1 via the second communication interface 30 to request the sewing machine 1 to transmit the first pattern information to the terminal apparatus 2 (S2). In response to receiving the first pattern information from the sewing machine 1 via the second communication interface 30 (S3: YES), the CPU 21 determines whether the first pattern information received from the sewing machine 1 corresponds to the sewing data transmitted from the terminal apparatus 2 to the sewing machine 1 (S4). In a case where it is determined that the first pattern information received from the sewing machine 1 via the second communication interface 30 corresponds to the sewing data transmitted from the terminal apparatus 2 to the sewing machine 1 (S4: YES), the notification process is resumed in S25. In response to receiving the connection request, the CPU 61 of the sewing machine 1 transmits the first pattern information stored in the memory 64 to the terminal apparatus 2 (S70). In the system 4, since the terminal apparatus 2 performs the process of S4, the sewing of the embroidery pattern by the sewing machine 1 is not hindered.

The monitoring program performed by the CPU 21 of the terminal apparatus 2 including the CPU 21 and the second communication interface 30 configured to communicate with the sewing machine 1 includes an instruction to perform a process of acquiring the sewing data including the needle position data indicating the needle position in a case where the embroidery pattern is sewn by the sewing machine 1 (S7). The monitoring program includes instructions to cause the CPU 21 to transmit the sewing data to the sewing machine 1 via the second communication interface 30 (S11) and transmit the restoration data corresponding to the sewing data to the sewing machine 1 via the second communication interface 30 (S30) in a case where it is determined that the sewing machine 1 has restarted during sewing of the embroidery pattern based on the sewing data and that the first pattern information corresponding to the sewing data and stored in the nonvolatile memory 64 of the sewing machine 1 corresponds to the sewing data transmitted to the sewing machine 1 in S11. The monitoring program causes the CPU 21 to transmit the restoration data to the sewing machine 1 in a case where the first pattern information stored in the memory 64 of the restarted sewing machine 1 corresponds to the sewing data transmitted from the terminal apparatus 2 to the sewing machine 1 before the restart. This suppresses erroneously transmission of the restoration data to an unintended sewing machine 1 such as another sewing machine 1 that does not need to resume sewing.

The sewing machine 1 includes the needle bar 6, the communication interface 67 configured to communicate with the terminal apparatus 2, and the CPU 61. The CPU 61 receives, via the communication interface 67, the sewing data including the needle position data indicating the needle position in a case where the embroidery pattern is sewn, which is transmitted from the terminal apparatus 2 (S44). The CPU 61 drives the needle bar 6 to sew the embroidery pattern based on the sewing data (S52). In a case where the sewing machine 1 is restarted during execution of the sewing control operation, in response to receiving the restoration data corresponding to the sewing data from the terminal apparatus 2 via the communication interface 67, the CPU 61 drives the needle bar 6 based on the restoration data and resumes the sewing control operation (S63). In a case where the sewing machine 1 is restarted while the embroidery pattern is being sewn by the sewing machine 1, the sewing machine 1 contributes to resuming the sewing of the embroidery pattern based on the restoration data that is transmitted from the terminal apparatus 2.

The sewing machine 1 includes the nonvolatile memory 64 and the volatile RAM 63. The CPU 61 stores the received sewing data in the RAM 63 (S45). The CPU 61 stores the number of sewn stitches in the memory 64 during execution of the sewing control operation (S68). In a case where the sewing machine 1 is restarted, in response to receiving the restoration data from the terminal apparatus 2 via the communication interface 67 (S58: YES), the CPU 61 drives the needle bar 6 based on the restoration data and the number of sewn stitches stored in the memory 64 and resumes the sewing control operation (S63). Even in a case where the sewing machine 1 is restarted during execution of the sewing control operation and the sewing data stored in the RAM 63 is lost, the sewing machine 1 resumes the sewing control operation based on the restoration data transmitted from the terminal apparatus 2 after the restart.

When the sewing machine 1 is started, the CPU 61 determines whether the sewing machine 1 has restarted during execution of the sewing control operation (S41). In a case where it is determined in S41 that the sewing machine 1 has restarted during execution of the sewing control operation, in response to receiving the restoration data from the terminal apparatus 2 via the communication interface 67, in the sewing resumption process, the CPU 61 drives the needle bar 6 based on the restoration data and the number of sewn stitches stored in the memory 64 to resume the sewing control operation (S63). The sewing machine 1 resumes sewing of the embroidery pattern from an appropriate stitch number based on the number of sewn stitches stored in the memory 64.

The CPU 61 stores the first pattern information corresponding to the sewing data received in S44 in the memory 64 (S45). In a case where it is determined in S41 that the sewing machine 1 has restarted, the CPU 61 transmits the first pattern information to the terminal apparatus 2 via the communication interface 67 (S57). In response to receiving the restoration data from the terminal apparatus 2 after S57 (S58), the CPU 61 drives the needle bar 6 based on the restoration data and the number of sewn stitches stored in the memory 64 to resume the sewing control operation (S63). By storing the first pattern information that is necessary to identify the sewing data in the memory 64, even in a case where the sewing machine 1 is restarted during execution of the sewing control operation, the sewing machine 1 suppresses loss of the first pattern information.

While the present disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the present disclosure, and not limiting the present disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

The present disclosure may be implemented in various forms, and for example, may be implemented in the form of a non-transitory computer-readable medium storing a monitoring program, a sewing method performed by a sewing system, a monitoring method performed by a terminal controller of a terminal apparatus, a sewing control method performed by the sewing machine 1, and so on. The system 4 may include the server 3 or may not include the server 3.

(A) The configuration of the sewing machine 1 may be changed as appropriate. The sewing machine 1 may be any sewing machine configured to perform embroidery sewing, and may be an industrial sewing machine, a multi-needle sewing machine, or an embroidery sewing machine for professional use. The configuration of the terminal apparatus 2 may be changed as appropriate, and may be, for example, a PC, a smartphone, and so on. The sewing machine 1 may include at least a display or an input interface. The display 28 of the terminal apparatus 2 may be any display configured to display an image, and may be, for example, an organic electroluminescent display, a plasma display, a plasma tube array display, or an electronic paper display using electrophoresis and so on. The terminal apparatus 2 may include a speaker, an LED, a projector, and so on as a notification interface. The input interface 29 of the terminal apparatus 2 may be a keyboard, a mouse, a joystick, and so on, in addition to the touch screen.

(B) The program including instructions for performing the processes of FIGS. 3A, 3B, and 6A to 8B may be stored in the memory of each apparatus by the time each of the CPU 21 of the terminal apparatus 2, the CPU 61 of the sewing machine 1, and the CPU 31 of the server 3 in the system 4 performs the corresponding program. Thus, the method of acquiring the program, the acquisition path, and the device that stores the program may be changed as appropriate. The program performed by each apparatus may be received from another apparatus via a cable or wireless communication and stored in a storage device such as a memory. The other apparatuses include, for example, a PC and a server connected via a network.

(C) Each step of the terminal process is not limited to the example of being performed by the CPU 21, and a part or all of the steps may be performed by another electronic device (for example, an ASIC). Similarly, each step of the sewing machine process is not limited to the example of being performed by the CPU 61, and a part or all of the steps may be performed by another electronic device. Each step of the server process is not limited to the example of being performed by the CPU 31, and a part or all of the steps may be performed by another electronic device. The steps of the terminal process, the sewing machine process, and the server process may be performed by a plurality of electronic devices (for example, a plurality of CPUs) in a distributed manner. The order of the steps of the terminal process, the sewing machine process, and the server process may be changed, and steps may be omitted or added as necessary. The following changes may be made to the terminal process, the sewing machine process, and the server process as appropriate.

After start of the process of acquiring the sewing data in S7, the CPU 21 of the terminal apparatus 2 may start the process of S11 at a stage where the acquisition of the sewing data is not finished. After start of the process of S15, the CPU 61 of the sewing machine 1 may start the process of S52 at a stage where the process of S15 is not finished. For example, in a case where the editing data is set for each partial pattern, if there is editing data of partial sewing data of which the sewing order is first, even if reception of editing data of partial sewing data of which the sewing order is second is not completed, sewing can be performed with correction data corrected based on the editing data. Thus, at a point in time at which reception of the editing data of the partial sewing data that is first in the sewing order is completed, the CPU 61 may sew the partial pattern that is first in the sewing order and that has been edited in accordance with an editing operation, based on the first partial sewing data and the editing data. The CPU 21 of the terminal apparatus 2 may transmit, to the sewing machine 1, the sewing data obtained by correcting the sewing data acquired in S7 with the editing data, without transmitting the sewing data in S11. That is, the correction data (sewing data after correction) may be generated by the terminal apparatus 2. In this case, the CPU 21 may store the sewing data after correction in the memory 24, and in S30 transmit the sewing data after correction stored in the memory 24 to the sewing machine 1.

The CPU 61 may sew the edited embroidery pattern based on the sewing data and the editing data, without generating the correction data in S49. For example, in a case where only the position of the embroidery pattern is edited in response to the editing operation and where the needle position data does not indicate the absolute coordinates but indicates relative coordinates (movement amount) relative to the immediately-previous needle fall point in the sewing order, based on the editing data received in S46, the CPU 61 may move to the sewing start position and then perform sewing based on the sewing data of which reception is started in S44. Then, the embroidery pattern is sewn at the edited position without generating the correction data.

The editing operation may be changed as appropriate. For example, the CPU 21 may receive the editing operation by detecting selection of a key for instructing a change in angle, a change in position, or a change in size. The type of editing corresponding to the editing operation may be changed as appropriate. For example, the editing data may be data including one or more data selected from angle data, position data, and size data. The CPU 61 may accept a change in a thread color. In this case, the editing data does not need to include thread color data. The CPU 21 of the terminal apparatus 2 may transmit the sewing data including the thread color data to the sewing machine 1. In a case where the sewing machine 1 includes a display, a process of displaying the thread color of the thread that is next in the sewing order may be performed by the sewing machine 1, not by the terminal apparatus 2. The CPU 21 may transmit the sewing data and the editing data of one embroidery pattern to the sewing machine 1, then perform the terminal process for the next embroidery pattern while the sewing machine 1 is sewing the edited embroidery pattern based on the sewing data and the editing data.

The process (S41) performed by the sewing machine 1 when the sewing machine 1 is started to determine whether the sewing machine 1 has stopped during execution of the sewing control operation and restarted may be changed as appropriate, or may be omitted. The CPU 61 may acquire the current position of the holder 46 of the sewing machine 1 when the sewing machine 1 is started, and, in a case where the acquired current position is not a particular initial position, may determine that the sewing machine 1 has stopped during execution of the sewing control operation and restarted. When the sewing machine 1 is started, the CPU 61 may allow the user of the sewing machine 1 to input, via the switch 47, whether the sewing machine 1 has stopped during execution of the sewing control operation and restarted. The particular information stored in the memory 64 may be the editing data acquired in S46. The editing data requires a smaller storage capacity than the sewing data. Further, in a case where the editing data is stored in the memory 64, the restoration data does not need to include the editing data.

Similarly, the process (S1) performed by the terminal apparatus 2 when the terminal apparatus 2 is started to determine whether the terminal apparatus 2 has stopped during execution of the sewing control operation by the sewing machine 1 based on the sewing data transmitted from terminal apparatus 2 and restarted may be changed as appropriate or may be omitted. When the terminal apparatus 2 or the terminal process is started, the CPU 21 may allow the user of the terminal apparatus 2 to input, via the input interface 29, whether the terminal apparatus 2 has stopped during execution of the sewing control operation by the sewing machine 1 based on the sewing data transmitted from the terminal apparatus 2 and restarted. In a case where the sewing machine 1 has stopped during execution of the sewing control operation by the sewing machine 1 based on the sewing data transmitted from the terminal apparatus 2 and restarted, the CPU 21 may allow the user to input, via the input interface 29, the first pattern information corresponding to the sewing data that is currently sewn, and perform at least S4 or S29 based on the first pattern information acquired via the input interface 29.

The method of determining the position in the sewing data at which sewing of the embroidery pattern is to be resumed in S63 may be changed as appropriate. In a case where the sewing machine 1 has stopped during execution of the sewing control operation by the sewing machine 1 based on the sewing data transmitted from the terminal apparatus 2 and restarted, the CPU 21 may allow the user to input, via the input interface 29, information specifying the needle position data at which sewing of the sewing data is to be resumed. The information specifying the needle position may be a point added to an image of the embroidery pattern sewn based on the sewing data, or may be an image obtained by capturing a partial pattern sewn on the sewing workpiece. When the sewing machine 1 is started, the CPU 61 may acquire the current position of the holder 46 of the sewing machine 1, and may resume sewing from the needle position data corresponding to the acquired current position or the needle position data that is a particular amount before the needle position data corresponding to the current position in the sewing order.

At least S4 or S29 may be omitted, may be performed by the sewing machine 1 or the server 3, or may be changed as appropriate. At least the first pattern information or the second pattern information may not be the identification information of the sewing data. For example, the first pattern information may be time information at which the sewing machine 1 receives sewing data, and the second pattern information may be time information at which the terminal apparatus 2 transmits the sewing data. In this case, the CPU 21 may perform the processes of S4 and S29 based on whether the absolute value of the difference between the first pattern information and the second pattern information is smaller than a particular value. The processes of S18, S25, and S37 may be omitted or changed. The processes of S67 and S68 may be appropriately changed or may be omitted.

The above modifications may be combined as appropriate as long as no contradiction occurs. The applicant of the present application intends to obtain a patent for aspects combined with each other without departing from the spirit of the present disclosure and without causing contradiction, in addition to the combinations exemplified in the claims.

What is claimed is:

1. A sewing system comprising:

a sewing machine including a needle bar, a volatile memory, a nonvolatile sewing machine memory, a sewing machine communication interface, and a sewing machine controller; and a terminal apparatus including a terminal controller and a terminal communication interface configured to communicate with the sewing machine, the terminal controller being configured to perform:

acquiring sewing data including needle position data indicating needle positions for sewing an embroidery pattern by the sewing machine; and transmitting the sewing data to the sewing machine via the terminal communication interface, the sewing machine controller being configured to perform:

receiving the sewing data transmitted from the terminal apparatus via the sewing machine communication interface;

in response to receiving the sewing data, storing the sewing data in the volatile memory, and storing first pattern information corresponding to the sewing data in the sewing machine memory;

performing a sewing control operation of driving the needle bar to sew the embroidery pattern based on the sewing data; and when the sewing machine is started, determining whether the sewing machine has stopped during execution of the sewing control operation and has restarted, the terminal controller being configured to perform:

in a case where it is determined that the sewing machine has stopped during execution of the sewing control operation and has restarted and that the first pattern information stored in the sewing machine memory of the restarted sewing machine corresponds to the sewing data transmitted from the terminal apparatus to the sewing machine before restart of the sewing machine, transmitting restoration data to the sewing machine via the terminal communication interface, the restoration data being data corresponding to the sewing data, the sewing machine controller being configured to perform:

in response to receiving the restoration data from the terminal apparatus via the sewing machine communication interface, driving the needle bar to resume the sewing control operation based on the restoration data.

2. The sewing system according to claim 1, wherein the sewing machine controller is configured to perform:

in response to determining that the sewing machine has stopped during execution of the sewing control operation and has restarted, transmitting the first pattern information to the terminal apparatus via the sewing machine communication interface; and wherein the terminal controller is configured to perform:

in response to receiving the first pattern information from the sewing machine via the terminal communication interface, determining whether the first pattern information received from the sewing machine corresponds to the sewing data transmitted from the terminal apparatus to the sewing machine; and in response to determining that the first pattern information received from the sewing machine corresponds to the sewing data transmitted from the terminal apparatus to the sewing machine, transmitting the restoration data to the sewing machine via the terminal communication interface.

3. The sewing system according to claim 2, wherein the first pattern information is identification information of the sewing data.

4. The sewing system according to claim 2, wherein the terminal apparatus further comprises a terminal memory; and wherein the terminal controller is configured to perform:

storing, in the terminal memory, second pattern information corresponding to the sewing data transmitted from the terminal apparatus to the sewing machine; and in response to receiving the first pattern information from the sewing machine, determining whether the first pattern information received from the sewing machine matches the second pattern information stored in the terminal memory, thereby determining whether the first pattern information received from the sewing machine corresponds to the sewing data transmitted from the terminal apparatus to the sewing machine.

5. The sewing system according to claim 4, wherein the sewing machine controller is configured to perform:

storing a status flag in the sewing machine memory, the status flag indicating whether the sewing control operation is being performed; and in a case where it is determined based on the status flag that the sewing control operation is being performed when the sewing machine is started, determining that the sewing machine has stopped during execution of the sewing control operation and has restarted.

6. The sewing system according to claim 2, wherein the sewing system further comprises a server configured to communicate with the terminal apparatus, the server including a server memory and a server controller;

wherein the terminal controller is configured to perform:

transmitting a storing request to the server, the storing request being a request to store second pattern information and terminal information in the server memory in association with each other, the second pattern information corresponding to the sewing data transmitted from the terminal apparatus to the sewing machine, the terminal information identifying the terminal apparatus; and in response to receiving the first pattern information from the sewing machine, transmitting a transmission request to the server, the transmission request being a request to transmit, to the terminal apparatus, the second pattern information corresponding to the terminal information of the terminal apparatus;

wherein the server controller is configured to perform:

in response to receiving the storing request from the terminal apparatus, storing the second pattern information and the terminal information in the server memory in association with each other; and in response to receiving the transmission request from the terminal apparatus, transmitting, to the terminal apparatus, the second pattern information corresponding to the terminal information stored in the server memory; and wherein the terminal controller is configured to perform:

in response to receiving the first pattern information from the sewing machine, determining whether the first pattern information received from the sewing machine matches the second pattern information transmitted from the server, thereby determining whether the first pattern information received from the sewing machine corresponds to the sewing data transmitted from the terminal apparatus to the sewing machine.

7. The sewing system according to claim 1, wherein the sewing machine controller is configured to perform:

storing a number of sewn stitches in the sewing machine memory during execution of the sewing control operation, the number of sewn stitches being a number of stitches that have been sewn based on the sewing data; and in response to receiving the restoration data, resuming, based on the restoration data, sewing of the embroidery pattern from a stitch number corresponding to the number of sewn stitches stored in the sewing machine memory.

8. The sewing system according to claim 7, wherein the sewing machine controller is configured to perform:

in response to completion of the sewing control operation, deleting the number of sewn stitches and the first pattern information from the sewing machine memory; and in response to determining that the number of sewn stitches and the first pattern information are stored in the sewing machine memory when the sewing machine is started, determining that the number of sewn stitches and the first pattern information have not been deleted and the sewing machine has stopped during execution of the sewing control operation and has restarted.

9. The sewing system according to claim 1, wherein the terminal apparatus further comprises a notification interface;

wherein the sewing machine controller is configured to perform:

after receiving the sewing data, transmitting an execution status of the sewing control operation to the terminal apparatus via the sewing machine communication interface; and wherein the terminal controller is configured to perform:

when the terminal apparatus is started, determining whether the terminal apparatus has restarted during execution of the sewing control operation by the sewing machine;

in response to not determining that the terminal apparatus has restarted during execution of the sewing control operation by the sewing machine, receiving a selection operation of selecting one embroidery pattern from among a plurality of embroidery patterns;

transmitting the sewing data of the selected embroidery pattern to the sewing machine via the terminal communication interface;

after transmitting the sewing data to the sewing machine, output the execution status transmitted from the sewing machine on the notification interface; and in response to determining that the terminal apparatus has restarted during execution of the sewing control operation by the sewing machine and that the first pattern information stored in the sewing machine memory corresponds to the sewing data transmitted from the terminal apparatus to the sewing machine, resuming output of the execution status.

10. The sewing system according to claim 9, wherein the terminal controller is configured to perform:

in response to determining that the terminal apparatus has restarted during execution of the sewing control operation by the sewing machine, transmitting a connection request to the sewing machine via the terminal communication interface, the connection request being a request to transmit the first pattern information to the terminal apparatus;

in response to receiving the first pattern information from the sewing machine via the terminal communication interface, determining whether the first pattern information received from the sewing machine corresponds to the sewing data transmitted from the terminal apparatus to the sewing machine; and in response to determining that the first pattern information received from the sewing machine corresponds to the sewing data transmitted from the terminal apparatus to the sewing machine, resuming output of the execution status; and wherein the sewing machine controller is configured to perform:

in response to receiving the connection request, transmitting the first pattern information stored in the sewing machine memory to the terminal apparatus.

11. The sewing system according to claim 1, wherein the first pattern information does not include the needle position data.

12. A sewing machine comprising:

a needle bar;

a communication interface configured to communicate with a terminal apparatus;

a first memory that is a nonvolatile memory;

a second memory that is a volatile memory; and a controller configured to perform:

receiving sewing data transmitted from the terminal apparatus via the communication interface, the sewing data including needle position data indicating needle positions for sewing an embroidery pattern;

in response to receiving the sewing data, storing the received sewing data in the second memory;

performing a sewing control operation of driving the needle bar to sew the embroidery pattern based on the sewing data;

storing a number of sewn stitches in the first memory during execution of the sewing control operation, the number of sewn stitches being a number of stitches that have been sewn based on the sewing data; and in response to determining that the sewing machine has stopped during execution of the sewing control operation and has restarted and in response to receiving restoration data corresponding to the sewing data from the terminal apparatus via the communication interface, driving the needle bar to resume the sewing control operation based on the restoration data and on the number of sewn stitches stored in the first memory.

13. The sewing machine according to claim 12, wherein the controller is configured to perform:

when the sewing machine is started, determining whether the sewing machine has stopped during execution of the sewing control operation and has restarted; and in response to determining that the sewing machine has stopped during execution of the sewing control operation and has restarted and in response to receiving the restoration data from the terminal apparatus via the communication interface, driving the needle bar to resume the sewing control operation based on the restoration data and the number of sewn stitches stored in the first memory.

14. The sewing machine according to claim 13, wherein the controller is configured to perform:

storing first pattern information in the first memory, the first pattern information corresponding to the sewing data transmitted from the terminal apparatus;

in response to determining that the sewing machine has stopped during execution of the sewing control operation and has restarted, transmitting the first pattern information stored in the first memory to the terminal apparatus via the communication interface; and after transmitting the first pattern information to the terminal apparatus, in response to receiving the restoration data from the terminal apparatus, driving the needle bar to resume the sewing control operation based on the restoration data and the number of sewn stitches stored in the first memory.

15. The sewing machine according to claim 14, wherein the first pattern information is identification information of the sewing data.

16. The sewing machine according to claim 14, wherein the controller is configured to perform:

in response to completion of the sewing control operation, deleting the number of sewn stitches and the first pattern information from the first memory; and in response to determining that the number of sewn stitches and the first pattern information are stored in the first memory when the sewing machine is started, determining that the number of sewn stitches and the first pattern information have not been deleted and that the sewing machine has stopped during execution of the sewing control operation and has restarted.

17. The sewing machine according to claim 14, wherein the controller is configured to perform:

in response to receiving a connection request from the terminal apparatus, transmitting the first pattern information stored in the first memory to the terminal apparatus, the connection request being a request to transmit the first pattern information to the terminal apparatus, the connection request being transmitted from the terminal apparatus when the terminal apparatus has restarted.

18. The sewing machine according to claim 12, wherein the controller is configured to perform:

storing a status flag in the first memory, the status flag indicating whether the sewing control operation is being performed; and in a case where it is determined based on the status flag that the sewing control operation is being performed when the sewing machine is started, determining that the sewing machine has stopped during execution of the sewing control operation and has restarted.

19. A sewing machine comprising:

a needle bar;

a volatile memory;

a nonvolatile memory;

a communication interface; and a controller configured to perform:

receiving sewing data transmitted from a terminal apparatus via the communication interface, the sewing data including needle position data indicating needle positions for sewing an embroidery pattern by the sewing machine;

in response to receiving the sewing data, storing the sewing data in the volatile memory, and storing first pattern information corresponding to the sewing data in the nonvolatile memory;

performing a sewing control operation of driving the needle bar to sew the embroidery pattern based on the sewing data;

when the sewing machine is started, determining whether the sewing machine has stopped during execution of the sewing control operation and has restarted; and in response to receiving restoration data from the terminal apparatus via the communication interface, driving the needle bar to resume the sewing control operation based on the restoration data.

* * * * *